US009562393B2

(12) United States Patent
Renouard et al.

(10) Patent No.: US 9,562,393 B2
(45) Date of Patent: Feb. 7, 2017

(54) HUMAN-POWERED BOREHOLE DRILL

(71) Applicants: John Renouard, South Jordan, UT (US); Sabin Gautam, Provo, UT (US); Eric Alli Janmohamed, Salt Lake City, UT (US); Kenneth Roy Langley, Orem, UT (US); Devin Donald LeBaron, Provo, UT (US); James Edward Stacey, Provo, UT (US); Nathan Curtis Toone, Provo, UT (US)

(72) Inventors: John Renouard, South Jordan, UT (US); Sabin Gautam, Provo, UT (US); Eric Alli Janmohamed, Salt Lake City, UT (US); Kenneth Roy Langley, Orem, UT (US); Devin Donald LeBaron, Provo, UT (US); James Edward Stacey, Provo, UT (US); Nathan Curtis Toone, Provo, UT (US)

( * ) Notice: Subject to any disclaimer, the term of this patent is extended or adjusted under 35 U.S.C. 154(b) by 368 days.

(21) Appl. No.: 13/744,412

(22) Filed: Jan. 17, 2013

(65) Prior Publication Data

US 2013/0206480 A1 Aug. 15, 2013

Related U.S. Application Data

(60) Provisional application No. 61/587,409, filed on Jan. 17, 2012.

(51) Int. Cl.

| | |
|---|---|
| ***E21B 7/00*** | (2006.01) |
| ***E21B 7/02*** | (2006.01) |
| ***E21B 11/00*** | (2006.01) |

(52) U.S. Cl.

CPC ..... *E21B 7/00* (2013.01); *E21B 7/021* (2013.01); *E21B 11/005* (2013.01)

(58) Field of Classification Search

CPC ..... E21B 4/00; E21B 7/00; E21B 11/005
USPC ..... 175/202, 203
See application file for complete search history.

(56) References Cited

U.S. PATENT DOCUMENTS

| | | | | |
|---|---|---|---|---|
| 52,868 | A * | 2/1866 | Lyon | 175/23 |
| 2,643,006 | A * | 6/1953 | King | E21B 19/155 414/22.52 |
| 2,859,939 | A * | 11/1958 | Petrell | E21B 3/04 403/359.5 |
| 3,094,312 | A * | 6/1963 | Woolgar | E21B 3/04 173/149 |
| 3,877,529 | A * | 4/1975 | Litchfield | 175/65 |
| 4,905,768 | A * | 3/1990 | Lorenz | A01B 1/14 172/25 |
| 5,199,507 | A * | 4/1993 | Westmoreland | 173/147 |
| 6,315,059 | B1 * | 11/2001 | Geldean | 173/31 |
| 2008/0190667 | A1 * | 8/2008 | Pflieger | 175/57 |

* cited by examiner

*Primary Examiner* — Cathleen Hutchins
*Assistant Examiner* — Ronald Runyan
(74) *Attorney, Agent, or Firm* — Adam D. Stevens; Kirton McConkie

(57) ABSTRACT

A human-powered borehole drill bridges the gap between large drilling rigs and the other less-effective manual methods. Intended mainly for developing countries, the design is affordable and also extremely simple, as very little product support or spare parts will be needed. The drill uses conventional drill pipe and drill bits allowing the drill system to mimic more conventional methods of drilling and existing hardware to maintain uniformity in drilling and easier access to more drilling products.

17 Claims, 42 Drawing Sheets

HUMAN-POWERED BOREHOLE DRILL

CROSS-REFERENCE TO RELATED APPLICATIONS

This application claims the benefit of U.S. Provisional Application No. 61/587,409, filed Jan. 17, 2012.

BACKGROUND OF THE INVENTION

1. Field of the Invention

The present invention relates to borehole drills, and more particularly to a manual or human-powered borehole drill 2. Background and Related Art Tanzania is one of the many countries in the world that suffers from extreme poverty. Many of the hardships in Tanzania can be attributed to the lack of clean water. Despite the facts that the country is surrounded by three major lakes and an ocean, and 7% of its area is covered by fresh water, it is difficult to find clean water because the water is contaminated and not suitable for human consumption.

Potable, or drinkable, water is the basis for a better life. It is estimated that Tanzanian women and children spend an average of 2 hours a day just collecting water, and it is common to find people who walk 6 hours just to find water. Other than the time concerns, 80% of all disease in developing countries is caused by bad water. Many of these people die because of the lack of medicine and health care. Since these people are collecting contaminated water, they spend their time being sick, visiting doctors, and paying for medicine they cannot afford. Although the people know the water makes them sick, they have no alternative.

Installing a village water well dramatically reduces all of these concerns and provides clean water for up to 1,500 families. Not only can the children go to school and the people have more time to help themselves financially, but they also have more opportunities to start businesses and in turn help the village progress.

Unfortunately, many villages lack clean water wells because the current methods of drilling in Tanzania are limited by opposite extremes. One option for drilling a well is a professional drilling rig, which is too expensive (from $15,000 to $20,000), while the other option is a homemade drilling system, which is too primitive and therefore unsuccessful drilling beyond 100 feet, where potable water is reached.

Of course, a professional drilling rig can drill to depths sufficient to access clean drinking water, but it costs upwards of $20,000 to hire the rig for the few days required to drill the borehole. The villages that need these wells cannot afford to spend this extreme amount of money. As a result, they turn to homemade drilling systems, which often are insufficient. The primitive, manual methods with which they dig or drill simply cannot penetrate deep enough to access clean water. The two main manual methods in most developing countries are hand augering and Rota-sludge. Hand augering simply uses an auger to dig the earth away and is effective only in soft soil formations, reaching depths of no more than 30 m (about 100 ft). Rota-sludge is a less effective method because it reaches the same depths but has success in much less diverse formations. In all manual techniques, due to limited mechanical advantage and strength of tools, these methods generally are not sufficient to reach the depths required to access clean water.

BRIEF SUMMARY OF THE INVENTION

A human-powered borehole drill bridges the gap between the large drilling rigs and the other less effective manual methods. A human-powered borehole drill will enable the people to drill their own wells for roughly $1,500, or even less. Intended mainly for developing countries such as Tanzania, the design is affordable and also extremely simple, as very little product support or spare parts will be needed. The drill uses conventional drill pipe and drill bits allowing the drill system to mimic more conventional methods of drilling and existing hardware to maintain uniformity in drilling and easier access to more drilling products.

The human-powered borehole drill will provide clean drinking water to almost any location having an aquifer at a reasonable depth, including remote locations such as villages in Tanzania at an affordable cost. The drill is capable of drilling a six-inch borehole reaching 250 feet through various soil formations to reach potable water. In an effort to bridge the gap between expensive professional rigs and less effective homemade systems, the drill uses existing drill pipe and bits, operates strictly on human power and is portable to move from village to village.

The design consists of three major components: the structure, the wheel support, and the wheel. The structure is designed to withstand loads of over three times the weight of 250 feet of drill pipe before yielding. Additionally, the structure is designed with a low center of gravity to prevent tipping and to add stability to the drilling process. The lifting of the pipe is accomplished through the use of a winch and pulley system, which also allows the operators to control the penetration rate of the drill bit. The wheel support is able to stabilize and support the weight of the wheel and allows ready access to the borehole and the drill pipe beneath the wheel. The innovative design of the wheel consists of a hub that is permanently attached to the wheel support via a bearing and eight removable spokes. Each of the spokes is pinned in place on the hub, and additional strength is gained from cross braces that are placed between the spokes. This design also allows for easy transportation.

In addition to meeting the quantitative specifications for drilling a borehole, the final design also meets the economic specifications. It can be manufactured for less than $5,000 and because the design consists mostly of welded steel, the majority of manufacturing can be performed in local regions. The entire drilling rig can also be easily disassembled and transported in the bed of a regular-sized truck or on a small trailer and can even be manually transported for transportation to remote areas.

The design has been tested in both theory and reality. Many tests were conducted, culminating in a final test with a fully functional steel prototype in which a six-inch-diameter borehole, 27 feet deep, was drilled in a sandy soil condition. Including setup, drilling, and cleanup, the entire test was completed in a five-hour period. More than a dozen boreholes fitted with working hand pumps have been completed.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims. In addition, headings are provided to guide the discussion, but such headings are not intended to in any way be limiting of the scope of the invention.

Exemplary Functional Specifications:

Based on anticipated plans, goals, and research, various functional specifications to which the human-powered borehole drill would conform were originally defined. Of those, the ones that were deemed most influential on the design of the drill are set forth below in Table 1. The specific embodiments and examples set forth herein have been based on meeting or exceeding the functional specifications contained in Table 1. It should be understood that the illustrated embodiments and examples are merely examples of one potential design and configuration intended to meet one set of functional characteristics. It should also be understood that the embodiments and examples might be varied while still satisfying or exceeding the functional characteristics shown in Table 1, or that the embodiments and examples might also be varied to satisfy or exceed other functional characteristics depending on the specific needs. Therefore, the illustrated examples and embodiments are intended to be instructional and are not to be deemed limiting of the invention in its various forms.

TABLE 1

Functional Specifications

| Interpreted Needs | Metric | Units | Ideal Value | Marginal Value |
|---|---|---|---|---|
| The drill provides access to clean, potable water | Borehole depth | feet | 250 | 200 |
| The drill structure supports the weight of the drill pipe | Maximum weight able to be supported by structure | pounds | 10000 | 5000 |
| | Weight of 250 feet of drill pipe | pounds | 3000 | 1500 |
| | Maximum pull-back force | pounds | 6000 | 3000 |
| The drill overcomes the compressive strength of rock | Downward force on drill bit | pounds | 3000 | 500 |
| | Applied torque to drill pipe | ft-lbs | 1500 | 500 |
| The drill turns fast | Rotations per minute | rpm | 60 | 20 |
| The drill uses existing drill pipe | Percentage of on-market drill pipe | % | 100 | 90 |
| The drill uses existing drill bits | Percentage of on-market drill bits | % | 100 | 90 |
| The drill is affordable | Total develpment cost | USD | $1500 | $5000 |
| | Cost to remanufacture | USD | $1000 | $5000 |

Figure 1:
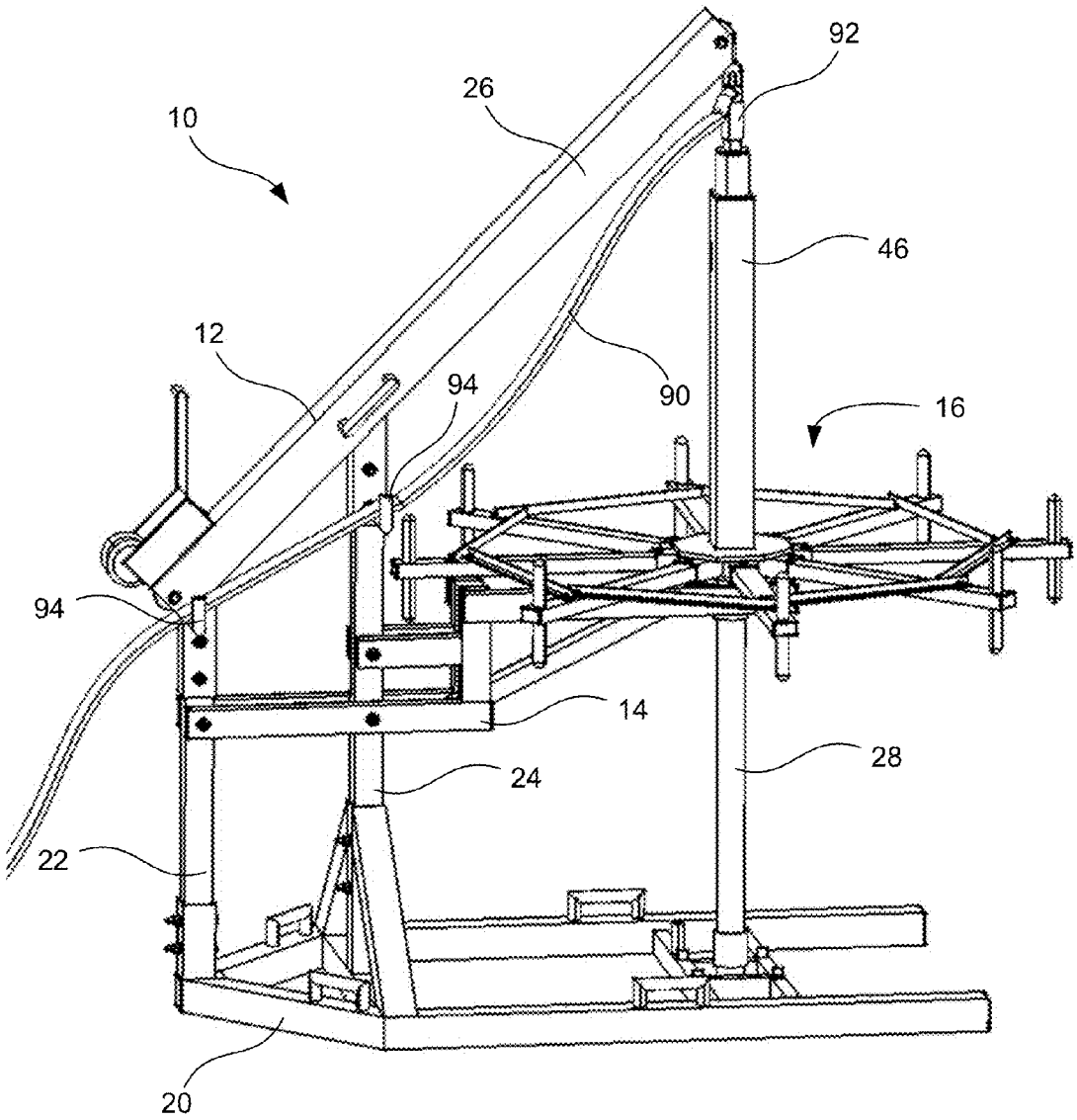
FIG. 1 shows an embodiment of a human-powered borehole drill.

Description of Exemplary Drill:

FIG. 1 shows a depiction of a human-powered borehole drill 10 in its assembled state. The structure of the drill 10 has three main components: a supporting structure 12, a wheel support 14, and a wheel 16. The various components of the drill 10 can be manufactured of any materials having desired cost, strength, and availability characteristics, as is known in the art. In one exemplary embodiment, the drill 10 is mostly constructed of steel parts that are welded and/or bolted together to assemble the complete structure. As such, the drill 10 can be largely manufactured locally without the need of expensive and specialized machining equipment, reducing manufacturing and distribution costs. The entire structure can be disassembled and transported in the bed of a regular size pick-up truck (approximately five and one-half feet wide and seven feet long). This falls well within the ideal value of being transported on a six-foot by ten-foot trailer. As a whole, the final design costs less than $5,000 to manufacture, and will presumably cost less if manufactured at higher quantities.

Figure 7:
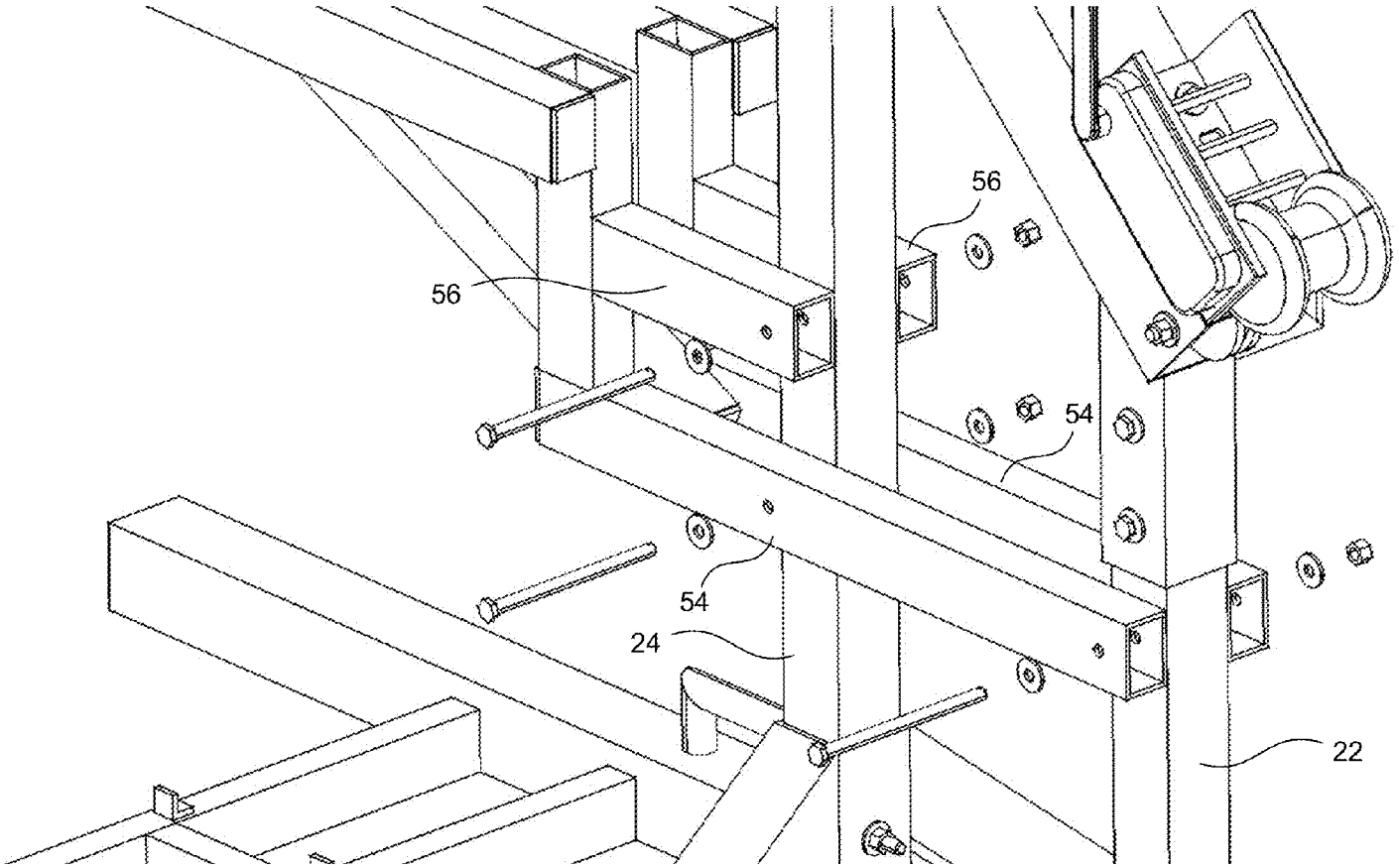
FIGS. 7-8 show steps for securing the components of FIGS. 3-6 together.

The components and assembly of the supporting structure 12 are shown in FIGS. 2-5 and 8. The final bolting of the supporting structure 12 shown in FIG. 8 occurs after the wheel support 14 is attached to the supporting structure 12 as shown in FIG. 7 and discussed below. The supporting structure 12 is roughly composed of four parts: a base 20, a first vertical column 22, a second vertical column 24, and a cantilevered beam 26 for lifting a drill pipe 28. As depicted more clearly in FIG. 3, the base 20 has two horizontal legs 30 sufficiently long and spaced wide enough apart to keep the structure 12 balanced and stable. The base 20 overall is approximately forty-seven inches wide and eighty-four inches long. It is constructed of three-and-one-half-inch square tubing, ⅜ of an inch thick. The size and mass of the base 20 keep the center of gravity for the whole structure 12 low to prevent tipping over. In order to tip, the structure has to rotate 36.7 degrees from the vertical. To cause this rotation a horizontal force of 220 pounds must be applied to the high-end of the cantilever beam 26, or a horizontal force of 352 pounds must be applied at the top of the five-foot second vertical column 24. The likelihood that these large forces will be applied to the structure 12 is extremely low.

The first vertical column 22 and the second vertical column 24 are three-inch square tubes, ¼ of an inch thick. This allows enough clearance to slide into a first sleeve 32 and a second sleeve 34 of the base 20, while remaining strong enough to withstand the applied loads. A series of rectangular steel tubing sections are welded between the legs of the base over the borehole for additional support. They also provide a rest for a slip plate 38 (see FIG. 24), which is used to secure the pipe 28 during changeover (adding or removing sections of pipe 28).

The cantilevered beam 26 is a five-inch square steel tube that is seven feet long with a thickness of 3/16 of an inch. The beam 26 has two sleeves 40 of three-and-one-half-inch steel tubing welded at a 45-degree angle that allow the beam 26 to be slid securely on top of the first and second vertical columns 22, 24. The beam 26 will be pinned to the columns 22, 24 by four four-inch-long clevis pins. The high end of the beam 26 is nine feet above the ground, directly above the borehole. Both ends of the beam 26 have a pulley 42 inside, and a winch 44 is attached to the low end of the beam 26. The wire rope or cable from the winch 44 goes through the beam 26 and can then hook onto the pipe 28 or a Kelly bar 46 (see below) for lifting.

The functional specification for the lifting system is to be able to support and lift the weight of 250 feet of drill pipe. Based on the density of steel (490.6 pounds per cubic foot), a pipe wall thickness of 0.25 inches, and an outer diameter of 2.875 inches, the weight of 250 feet of pipe is 1725 pounds. While drilling, the borehole may cave in on top of the pipe; thus necessitating the ability to lift more than the just the weight of the drill pipe.

The three major components of the lifting system are the hoist structure, the winch 44, and the pulleys 42. The hoist structure was designed to never yield, even under extreme lifting conditions. Because of the length of the cantilevered beam 26, the highest stresses occur in the beam 26 at the junction with the first vertical column 22. This stress is due to a combined bending load and axial load. Therefore, to select the appropriate beam size of the beam 26, the von Mises stresses were calculated at this point. A simple optimization program was created in Excel to optimize the beam dimensions given a load, a safety factor, and a beam wall thickness. From this optimization routine a five-inch square steel beam was chosen with the yield strength of steel as 50,000 psi, a safety factor of 1.5, a wall thickness of 0.188 inches and a vertical load of 4,500 pounds. If other design considerations are applicable, a similar optimization could be used to create a satisfactory design for those conditions.

The winch 44 and pulleys 42 were then chosen to be able to lift the weight of the pipe 28 and more, but both of these components have a lower capacity than the beam 26. The goal was to ensure that there would never be any failure of the lifting structure. A hand winch with a 3,500 pound first layer capacity (and an 1849 pound full drum capacity) was selected as the winch 44. The selected winch has an enclosed gear for protection from the harsh environments of drilling, and it has an automatic brake, which means that it cannot move unless an operator is rotating the handle even with tension in the wire rope. Furthermore, at its maximum capacity the operator only has to apply 19.4 pounds of force to the end of the winch handle to move the load.

The pulleys 42 were selected to match the lifting capabilities of the winch 44 as closely as possible; however, the pulleys 42 were also constrained in size by the inside dimension of the beam 26. Stainless steel pulleys with a 4.25-inch diameter and plain bronze bearings were selected. These pulleys have an operating capacity of 3,000 pounds.

One major advantage that the structure shown in FIG. 1 and described above is the ability to apply upward force to the drill pipe 28 while drilling. This is a result of having a structure that is always in place over the hole. The upward pressure prevents the drill bit from becoming lodged in soil at the bottom of the borehole. This ultimately results in a smaller average torque applied to the pipe 28. This structure also allows the winch 44 to impart a constant vertical force while raising or lowering the pipe instead of a force that decreases as the pipe 28 approaches the top of the structure as in a design with a block and tackle pulling from two sides.

Figure 6:
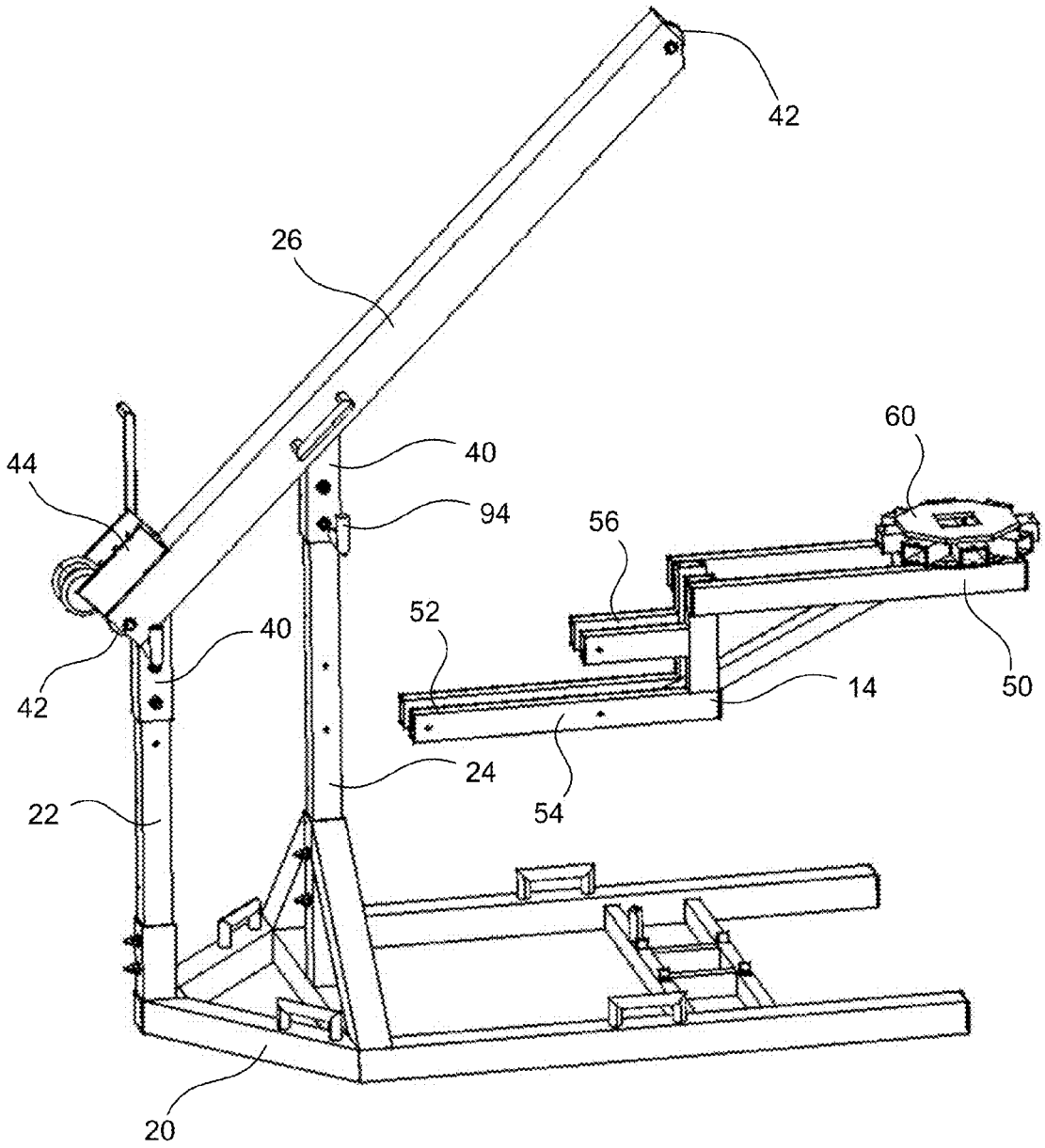
FIG. 6 shows a wheel support being attached to the vertical columns of FIGS. 4 and 5.

Assembly of the wheel support 14 to the structure 12 is shown in FIGS. 6-7. The wheel support 14 is made of several three-inch by two-inch rectangular steel tubing sections that are welded together to make a platform 50 on one end that a lazy Susan bearing and the wheel 16 can rest on (see FIG. 6). The other end 52 has sections of tubing spaced wide enough to fit over the vertical columns 22, 24 of the structure 12. Two parallel long sections 54 slide around both columns 22, 24 and are bolted in place. Two smaller short sections 56 six inches above the long sections 54 slide around the second vertical column 24 only and are bolted in place. Bolting the wheel support 14 to the columns 22, 24 in this manner and as shown in FIG. 7 provides more structural stability to the structure 12 and the wheel support 14.

The platform 50 end is approximately forty-five inches from the ground, which will make it ergonomically ideal for an average height operator to turn the wheel. The platform 50 is twelve inches wide with ample space in the middle for the Kelly bar 46 and pipe 28 to slide through. Essentially, the only load that will be seen by the wheel support 14 is the weight of the wheel 16 itself.

This wheel support 14 is advantageous in that it allows unimpeded access to the drill pipe 28 that is beneath the wheel 16. In other designs, cross braces that provided structural stability to the table or platform that supported the wheel restricted access to the pipe 28 and made adding or removing pipe sections difficult. Also, this wheel support 14 offers more strength and stability because it is attached to a rigid structure 12 with a wide base 20.

FIGS. 9-14 show assembly of the wheel 16. The wheel 16 is made up of a central hub 60 and eight spokes 62 (see FIG. 13). The hub 60 has eight inch-long sections of three-inch by two-inch rectangular steel tubing that are spaced evenly in a circular or octagonal pattern with open ends facing outward. These form sleeves 64 into which the spokes 62 are inserted. The sleeves 64 are sandwiched between two ¼-inch-thick octagonal plates 66 that are twelve inches wide. The plates 66 have 4.1 inch square holes 68 in the middle that are aligned for the Kelly bar 46 to slide through. All components of the hub 60 are strongly welded together for robustness. A small piece of metal is welded to the inside bottom lip of each of the sleeves 64 of the hub 60 to prevent the spokes 62 from sagging. The wheel hub 60 is then attached to the wheel support 14 by a thrust bearing allowing the wheel 16 to spin freely.

The spokes 62 are three-foot long 1.5 inch by 2.5 inch rectangular tubing sections. One end of each spoke 62 fits into one of the sleeves 64 of the hub 60 and is pinned in place. The other end of each spoke 62 has an 11.5 inch long and 1.25-inch diameter solid steel rod 70 going through the middle perpendicular to the main axis of the spoke 62. A 1.25-inch diameter is ergonomically optimal for a power grip. Each rod 70 serves as a handle and is centered on the spoke 62 with five inches protruding both above and below the spoke 62. This accommodates people of different heights working on the drill 10. The outside end of the spoke 62 is closed and deburred for safety. For additional support of the wheel spokes 62, a 2 foot piece of one inch by one inch angle iron is pinned as a cross brace 72 between all adjacent spokes 62.

The six-foot diameter of the wheel 16 provides enough torque to drill efficiently in all soil types while still maintaining its portability. The spokes 62 are not permanently attached to the hub 60 so that the wheel 16 may easily be assembled and taken apart for transportation. Additionally, the weight of the wheel 16, especially the solid steel rods 70 serving as handles at the end of the spokes 62, provides enough inertia for the wheel 16 to maintain a continuous motion and act as a flywheel.

With the wheel 16 applying a constant torque to the drill pipe 28, it is possible that some angle of twist will develop through the length of the drill pipe 28 (within the borehole). This can cause unwanted wind-up that could potentially be dangerous if the wheel 16 were suddenly released. Therefore, calculations were performed to determine the twist angle with 250 feet of pipe 28 and a maximum torque of 1,000 foot-pounds, which corresponds to three operators exerting 111 pounds of force at the edge of the wheel. In the limiting case where the drill bit is held stationary, forty-nine degrees of twist will develop in the pipe. This would result in the wheel unwinding approximately ⅛ of a turn, which means that at most one spoke 62 will pass by the operator. In addition, with use of the winch 44 and the subsequent upward force that can be applied to the pipe 28, the situation in which the drill bit is held stationary can be avoided.

This wheel design holds many advantages over other possible designs. While testing with a wooden wheel prototype, it became apparent that moving six-foot diameter wheel was cumbersome and problematic. In order to begin the drilling process, the heavy wheel had to be slid over the top of the Kelly bar. Adjustment and placement of the wheel was also difficult because the operators had to work from three feet away. With the illustrated design of the wheel 16, the Kelly bar 46 is slid through the permanent hub 60. There are no awkward or heavy pieces to lift overhead and transport. Additionally the wheel 16 is able to be disassembled for transport and it can easily fit with in the required space (six feet by ten feet) with all of the other components.

The change-over process is facilitated by using three-foot sections of the pipe 28. The Kelly bar 46 has a square cross section slightly smaller than the diameter of the square hole 68 of the hub 60 and has a length of approximately 3 and ⅔ feet. Of course, the Kelly bar 46 and the hole 68 can be formed of any appropriate cross-section and corresponding shape that permits the transfer of torque from the wheel 16 to the Kelly bar 46 and thence to the pipe string. Regardless, this length of the Kelley bar 46 allows a quicker changeover and more manageable parts for manual labor.

When drilling starts, the Kelly bar 46 is almost completely above the wheel 16. As the drill cuts, the Kelly bar 46 and pipe 28 will lower until the top of the Kelly bar 46 is level with the top of the wheel hub 60. Then the winch operator lifts the pipe 28 until the slip plate 38 can fit under a coupler 80 between sections of pipe 28 and over the legs 36 of the base 20 (see FIG. 24). After unthreading the Kelly bar 46 from the drill pipe 28, the Kelly bar 46 is raised until it reaches the top of the cantilever beam 26. Then a new three-foot pipe section of pipe 28 can fit between the Kelly bar 46 and the top of the previous section of pipe 28 (see FIG. 26). The new section is threaded onto the pipe 28 using the coupler 80, and then onto the Kelly bar 46. This is done under the wheel 16 by one operator holding the pipe 28 with a pipe wrench 82 and the other operators tightening the Kelly bar 46 by turning the wheel 16 (as the drill 10 runs, the pipe sections will fully tighten). A wrench stop 84 has also been welded to the base 20 so that the operator does not have to supply the resistance to loosen or tighten the pipe 28 (See FIG. 25). Then the pipe 28 is lifted slightly until the slip plate 38 can be removed. Drilling can then continue. A more detailed explanation of the process is provided below.

The major advantage of the change-over process came with the decision to use pipe segments that are three feet long instead of pipe segments that are longer, thus allowing the Kelly bar 46 to never be removed completely. Likewise a pump hose 90 and a swivel 92 never need to be removed. The pump hose 90 rests on hose hooks 94 attached to the beam 26. The small pipe sections are also easy to lift and handle, and there is plenty of space to comfortably work on the changeover under the wheel 16. Since there is no need to completely remove the Kelly bar 46 and raise and lower the pipe string, this process is much faster and easier than if longer pipe sections were used.

The final design of the drilling rig may optionally include a human powered pump. For example, a treadle pump system may be used. Regardless, in order to operate an effective mud rotary drill, a drilling fluid must be utilized that can remove the cuttings from the borehole. This process occurs by pumping a viscous slurry down the hole through the center of the drill pipe. The slurry then returns through the annulus between the borehole wall and the pipe with the cuttings created by the drill bit. This process can remove any type of cuttings by adjusting the viscosity of the slurry. As one example, a slurry additive called bentonite may be mixed with water to change the viscosity of the slurry. Since the cuttings are typically denser than the slurry, a combination of fluid pressure and shear stress act on the cuttings to propel them to the surface.

This results in pump requirements that can provide the necessary flow rate and fluid pressure, as is known in the art. A flow rate of fifty to one hundred gallons per minute is sufficient to create the necessary shear stresses on the cuttings and remove the cuttings at a quick enough rate. In order to provide adequate pressure, the pump needs to provide one foot of pressure head for every foot of depth of the borehole. This equates to a pressure of approximately 100 psi at a depth of 250 feet. Using these pump specifications, a table of pump power requirements can be calculated to determine pump needs, including the feasibility of operating a pump or pumps with human power.

Prototype Testing Results:

The final design was generated by proving many different concepts in preliminary prototypes. The first concept that was proved through testing was the ability to turn the pipe by walking in circles around the pipe. The test was very simple. A drill bit was spot welded to a pipe, and using pipe wrenches, the pipe was gripped and turned. During this test, one inch of depth was drilled in ten minutes. Originally, a system that would have the workers walk around the pipe twisting it as they walked in circles was envisioned. However, while testing this primitive prototype the idea that it would be much easier to be stationary and pass the wrench around was developed. This idea was selected as a part of the first fully functional prototype.

The first fully functional prototype was made of wood. This was done to reduce cost and decrease manufacturing time. A six-foot wooden wheel was used to harness human power to turn the pipe. This wheel had vertical handles and was pushed along by up to six workers that could stand around it in a circle. This design could be both operated with minimal effort and apply large amounts of torque to the drill pipe. This prototype was first tested in a small hole to ensure its feasibility. It met all expectations. The inertia of the wheel was able to keep the drill spinning in between pushes. This made for a smooth operation. The diameter of the wheel was a good size to operate and it would easily enable operators to apply enough torque.

After the two proof of concept tests, the fully functional wooden prototype was finished. The next test location was selected because of ease of access to water and clay soil conditions. Parts of the design that were being proved were the pumping system, the wheel, and the amount of downward pressure needed to drill. Through twenty-four minutes of continuous drilling a hole twenty-nine inches deep was drilled. This corresponded to an average drilling rate of one inch per minute. From this test, it was evident that one human-powered treadle pump as then being tested could not provide enough flow to lift all of the cuttings out of the hole. This caused the drill to get stuck easily and increased the effort required by the operators to turn the wheel. When extra downward pressure was added the drill dug a little faster at first but then the bit became stuck. It was determined that the ability to remove the cuttings needed to be improved by adding a second treadle pump before the next test.

The next two tests were located where the soil contained rocks varying in diameter from one-half inch to four inches. This condition is known as cobblestone. These tests were performed on two separate days using the wooden prototype. In these tests a second pump was added and bentonite was used to thicken the drilling mud. This was done in hopes that the cuttings would be removed more effectively. However, during the second test both treadle pumps broke because they could not generate the pressure needed to move the thick slurry. During the second test a mud pump was rented to enable the rest of the prototype to be tested.

The first four feet went just as the test in clay, but then the cobblestones were encountered. The cobblestones made the drilling slow and arduous and it became difficult to measure progress. Since there was no way to lift the drill bit off of the bottom of the borehole, the cobblestones were simply moved around instead of being cut through. Despite the slow progress the prototype was able to drill through rock and pull up the cuttings with a mud pump. From the borehole a rock was pulled that had the profile of the drill bit carved in, and the settling pond had shovels full gravel as proof that the drill had drilled through and removed rock. During these tests it became apparent that the design made it hard to access under and around the table to add and remove pipe. This resulted in modifications to the design.

The final design needed to include a way to remove the wheel to provide greater access in and around the pipe interchange area. Also, a hoist that would always be in place so that the pipe could be lifted and lowered while drilling. At this point it was decided that the initial implementation of the drilling rig would use a gas-powered pump to pump the drilling slurry. Although this uses a consumable fuel, it will use drastically less fuel than a conventional rig.

The final test with the final steel prototype was performed in sandy soil conditions. In all, twenty-seven feet were drilled in one and one-half hours. The actual time the drill was spinning was twenty-one minutes. The average time for adding a new pipe was two and one-half minutes. Extrapolating from this data it is calculated that it would take approximately eleven hours to drill 250 feet. This number may be optimistic because it assumes that no problems will be encountered with increased depth that have not already been encountered; however, a professional driller present at the test stated that there is no reason to believe that it becomes harder to dig with increased depth. This makes the 11 hour estimate more feasible.

The ability to raise and lower the pipe while drilling was an important part of this success. When the drill's full weight was resting in the hole the drill would dig too fast and the wheel would become very hard to turn. The winch was used to control the rate of penetration. This made the drill easy to keep at an approximately constant thirty rotations per minute. Being able to keep a constant rhythm while spinning the wheel greatly increases its sustainability.

Before this test, the process of adding new pipe had only been tested once. The procedure was very difficult, dangerous and took an entire team to perform. One of the main purposes of the final test was to test the modified pipe changing procedure. In the final design, the pipe sections were made smaller, for easy handling, and cleared out space to work underneath the wheel. During the testing it was very easy to change the pipe with only two people. Overall the results were very pleasing. More than a dozen boreholes fitted with functioning hand pumps have been completed using embodiments of the drill 10.

Through testing, it was determined that the illustrated design is capable of drilling in several soil types including clay, sand and cobblestones. Although at times the progress may be slow, the drill 10 remains effective. The drill 10 is also easily transportable and robust.

Although not specifically illustrated in the drawings, several possible modifications to the design have been contemplated as a result of the testing process. As a whole the manufacturing of the device is accomplished with simple operations; however, there are a few components that are manufactured using mills. Ways to eliminate the need for these more complex operations could be sought. The drill 10 also contains many exposed moving parts, which might be better shielded to prevent the possible pinching of operators' body parts. Finally, ways to reduce the overall cost of the device could be sought. Any such changes are embraced by the various embodiments of the invention.

In addition, tool joints might be used at every pipe connection to improve change-over and prevent over-tightening of joints. Also, a second slip plate 38 could be added to introduce redundancy to better prevent the pipe 28 from falling down the borehole during the removal of pipe sections. A sealed thrust bearing could be used between the wheel hub 60 and the wheel support 14 to protect against corrosion and to improve the performance of the wheel 16. Finally, the wheel 16 could be provided with a unidirectional mechanism that can prevent the wheel 16 from being spun in the wrong direction and employing a method of stopping the wheel 16 while it is turning. Any of these changes are also embraced by the various embodiments of the invention.

Instructions for Use:

To further assist in understanding the illustrated embodiment of the invention, the following paragraphs provide instructions for using the drill 10. First, an appropriate location to drill, directly above an aquifer, is located. An appropriate water source is also located to be used to pump down the drill pipe 28 while drilling. A flat, level location of appropriate size is then selected.

Figure 2:
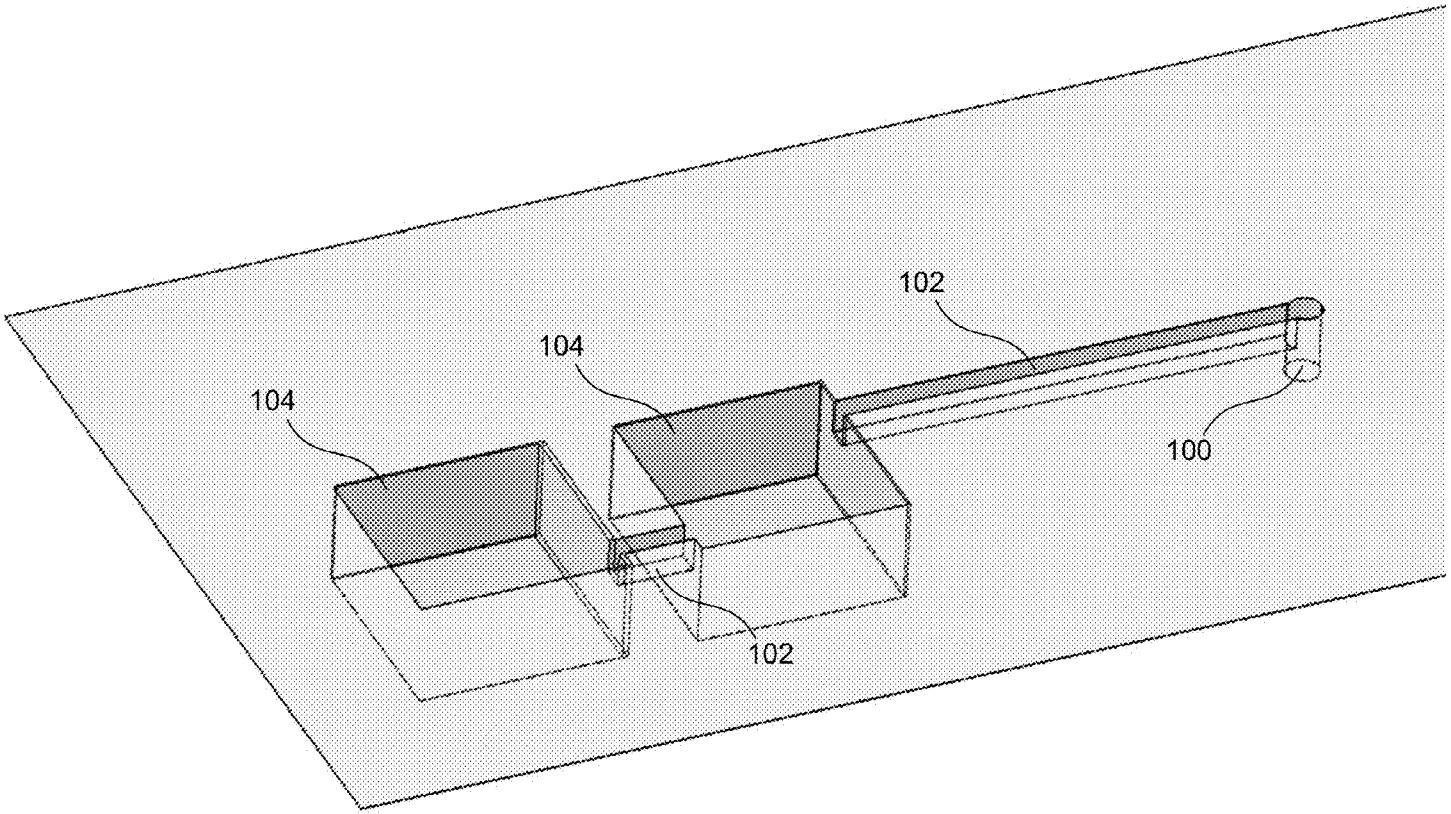
FIG. 2 shows a surface preparation of an underlying surface, the preparation being configured to receive the drill of FIG. 1.

As is illustrated in FIG. 2, a six-inch pilot hole 100 is then dug to a depth of approximately one foot. A trench 102 that is approximately four inches wide, six inches deep, and eight feet long is dug extending out one side of the pilot hole. At the other end of the trench, two large three-foot square by two-foot deep basins 104 are dug connected by another short trench 102. During the drilling process, silt and cuttings may need to be removed periodically from the trenches 102 and basins 104.

The structure 12, wheel support 14 and wheel 16 may be assembled at the same time as the slurry pump is set up. The slurry pump (not shown) is set up by placing the pump near the second basin 104 (that most distant from the pilot hole 100) and by feeding the pump inlet hose (also not shown) into the second basin 104. It should be ensured that a filter is in place to avoid clogging the pump with small pebbles. At the beginning, the outlet hose (not shown) is placed inside the pilot hole 100.

The trenches 102 and basin holes 104 are lined with Bentonite and all holes are filled with water until about three inches from ground level. The Bentonite will seal the trench and borehole walls reducing seepage and lowering the risk of down-the-hole cave-in. While the pump is running, cycling the water through the trench and basins, Bentonite is mixed in near the pump inlet hose, with vigorous stirring with a shovel. This is continued until the slurry is almost as thick as runny yogurt. Additional water or Bentonite may need to be added throughout the process to keep a proper slurry mixture.

Figure 3:
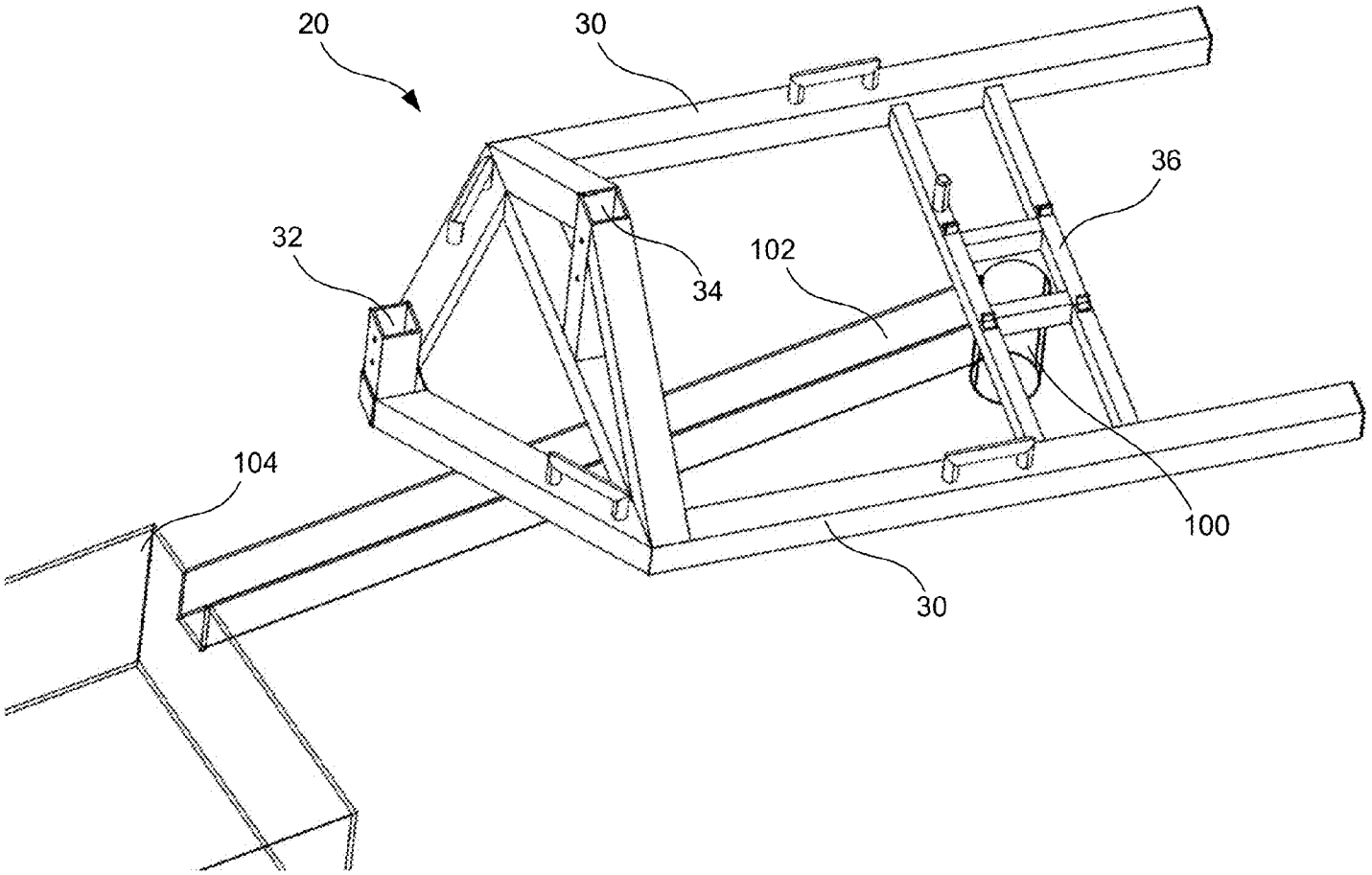
FIG. 3 shows a drill base placed on the surface of FIG. 2.

Meanwhile, as shown in FIG. 3, the base 20 is placed to align a square opening of the legs 36 over the pilot hole 100. The base 20 is positioned at an angle so that the trench 102 runs under cross braces and not the main uprights. Dirt may be filled in or removed as needed under portions of the base 20 until the base is level in all directions.

Figure 4:
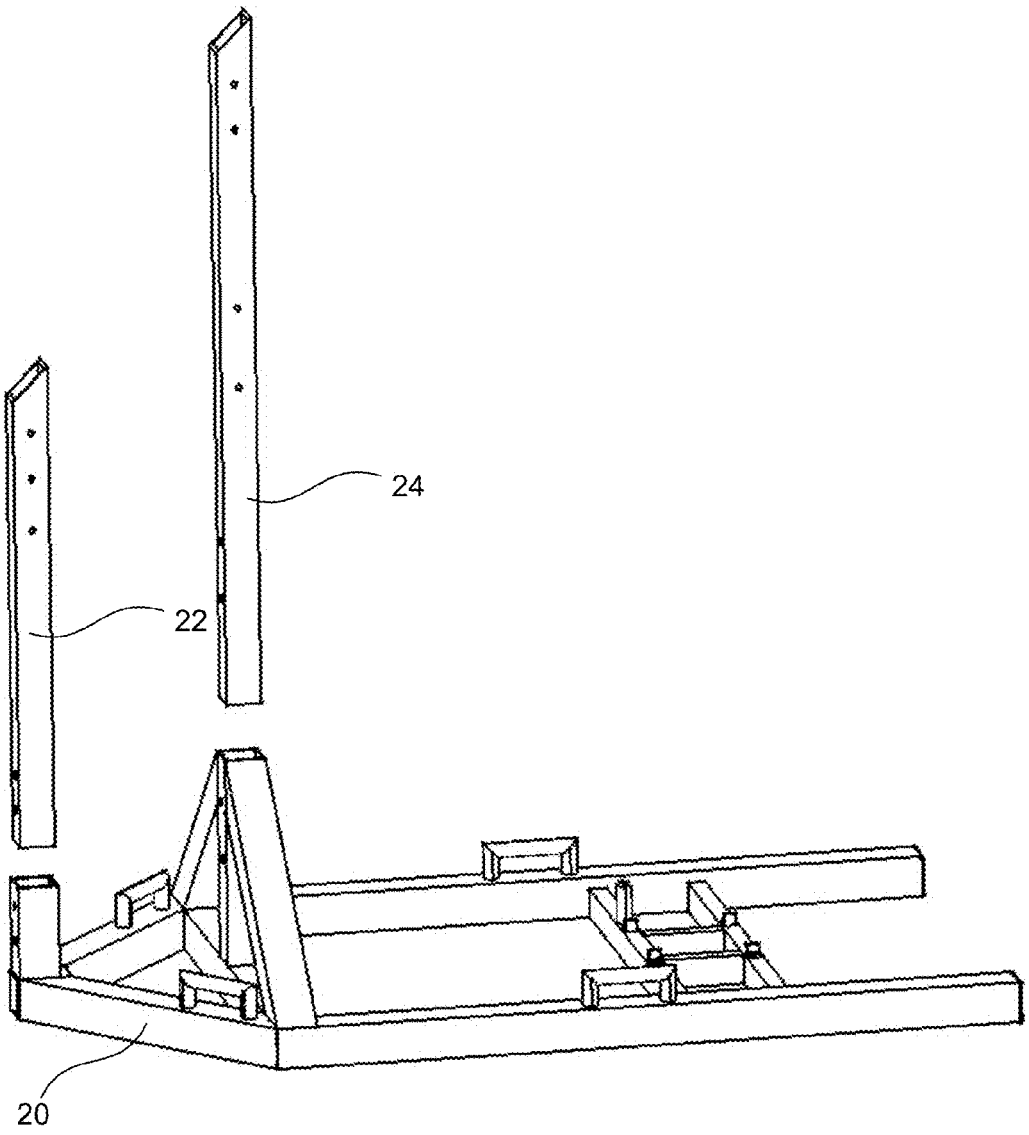
FIG. 4 shows vertical columns being inserted into the base of FIG. 3.
Figure 5:
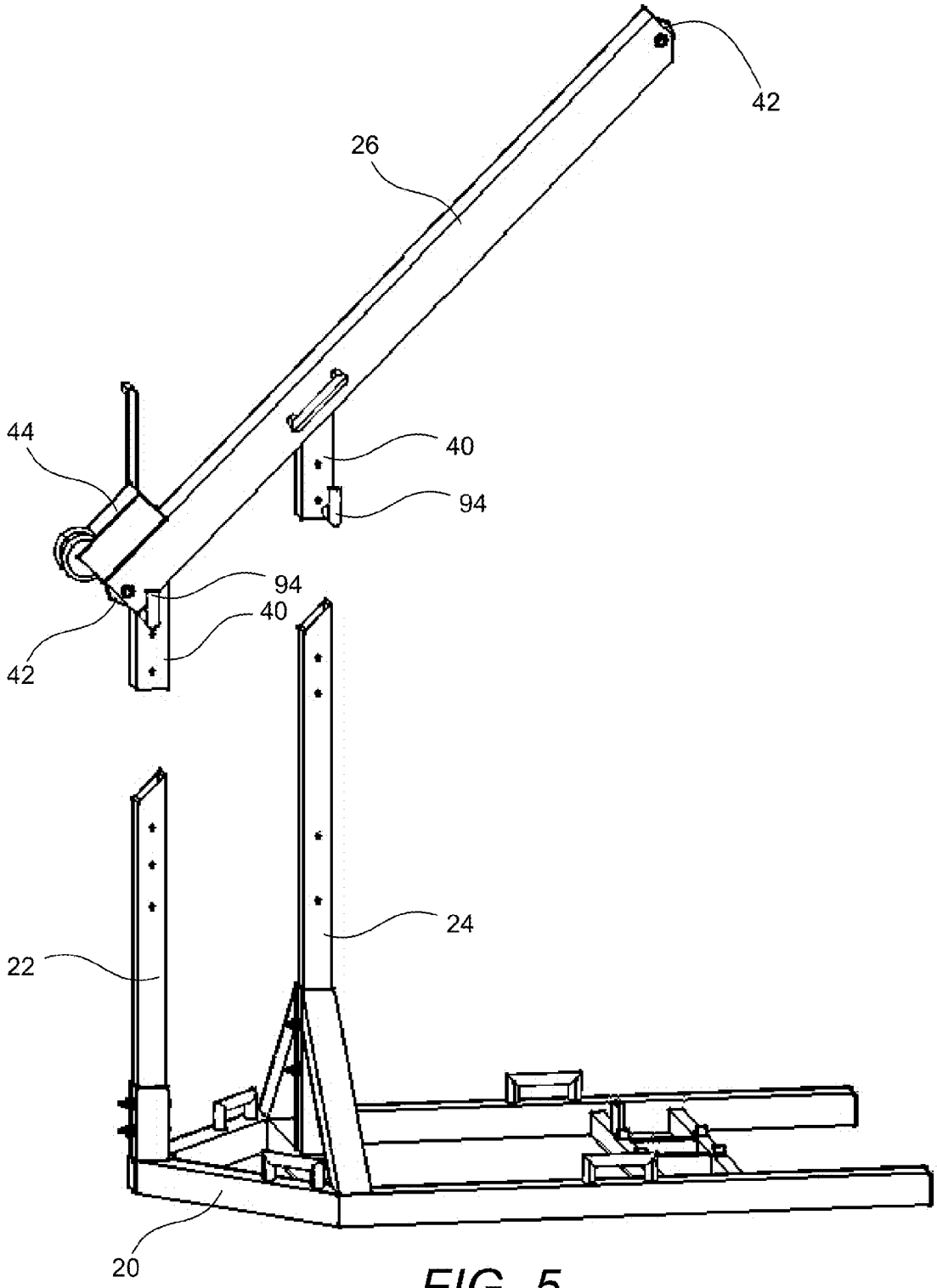
FIG. 5 shows a cantilevered beam being attached to the vertical columns of FIG. 4.
Figure 8:
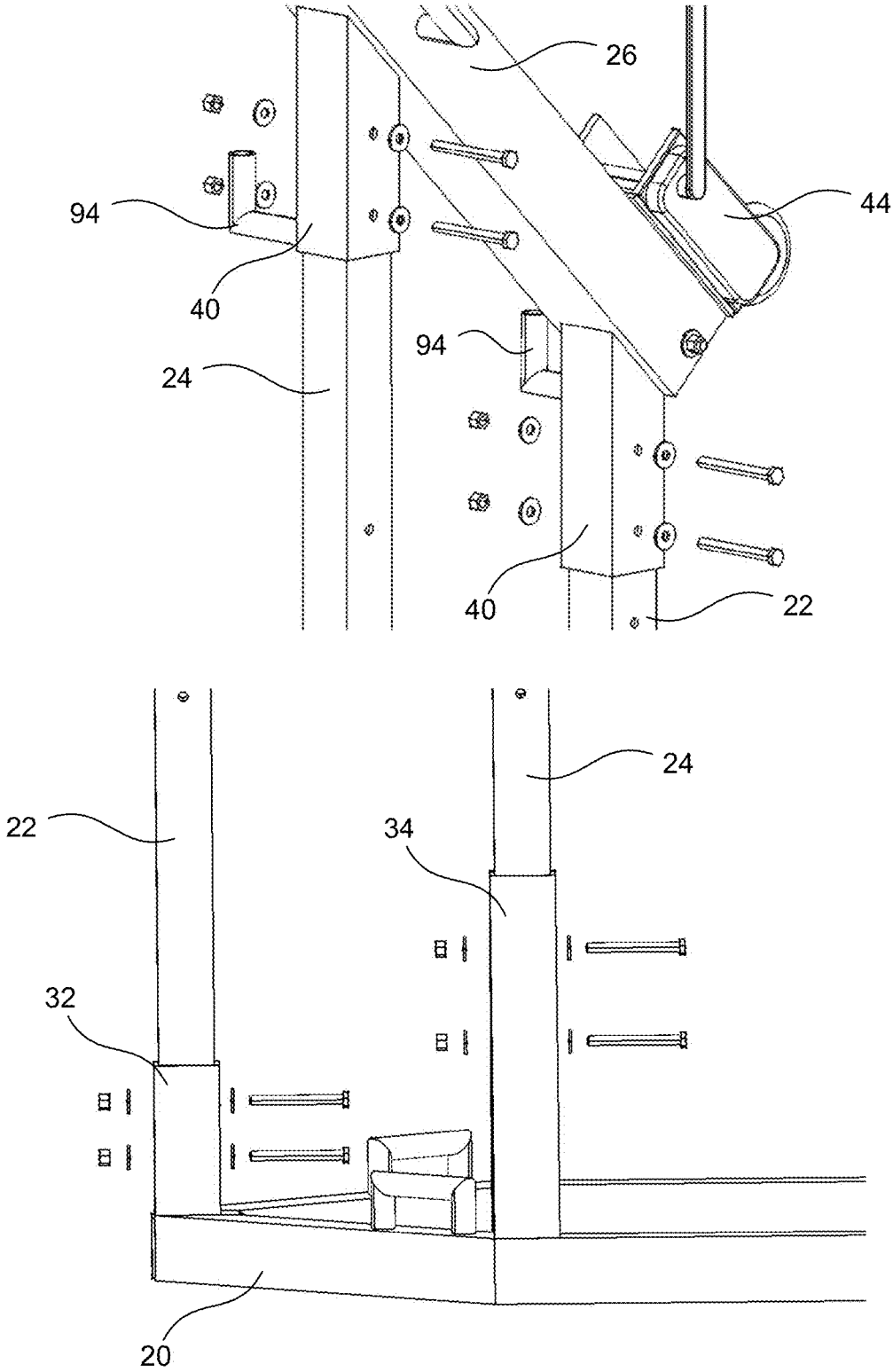

As shown in FIG. 4, both vertical columns 22, 24 are then inserted into the base 20. The vertical columns 22, 24 are not yet bolted to the base 20 to allow for flexibility in positioning the various components of the structure 12. Then, as shown in FIG. 5, the beam 26 (with its associated components) is placed on top of the vertical columns 22, 24. Again, bolts are not yet inserted. Next, as shown in FIG. 6, the wheel support 14 is positioned at its appropriate position on the vertical columns 22, 24 and is bolted to the vertical columns 22, 24 as shown in FIG. 7. At this point, the vertical columns 22, 24 may be bolted to the base 20 and to the beam 26 as shown in FIG. 8, and the structure 12 and wheel support 14 are checked to ensure that the entire assembly is secure and solid.

Figure 9:
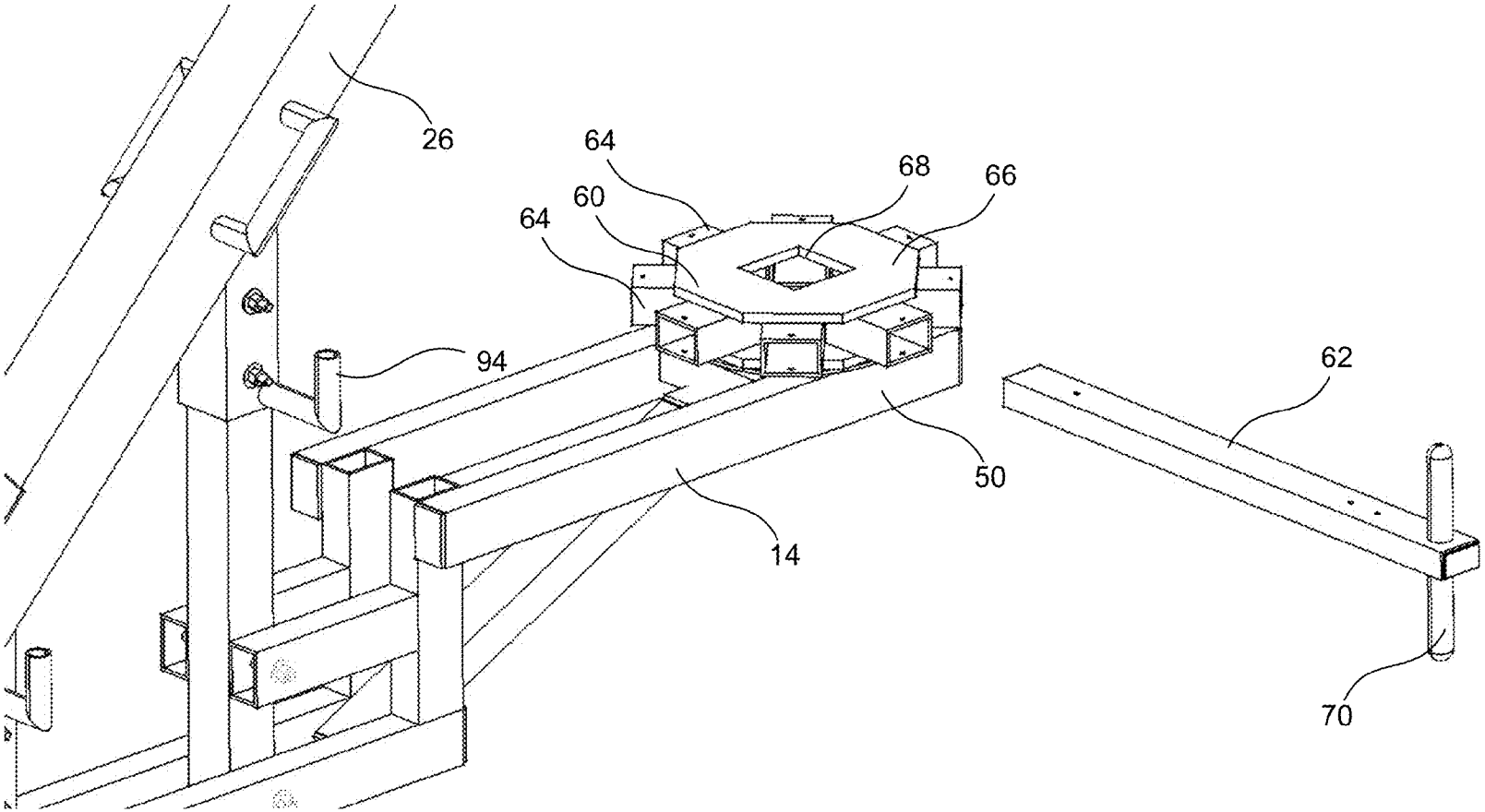
FIGS. 9-13 show steps for assembling a wheel.
Figure 10:
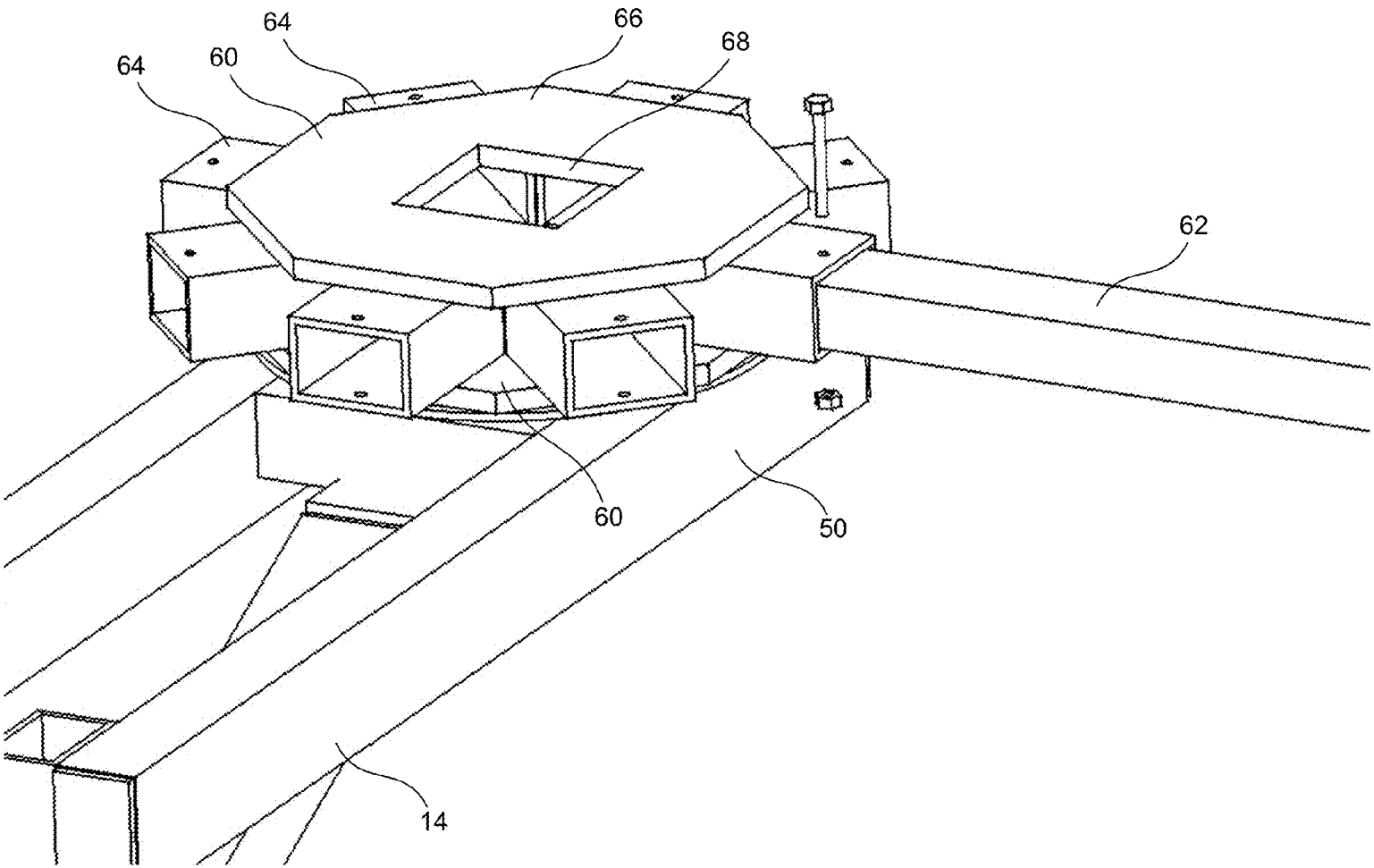
Figure 11:
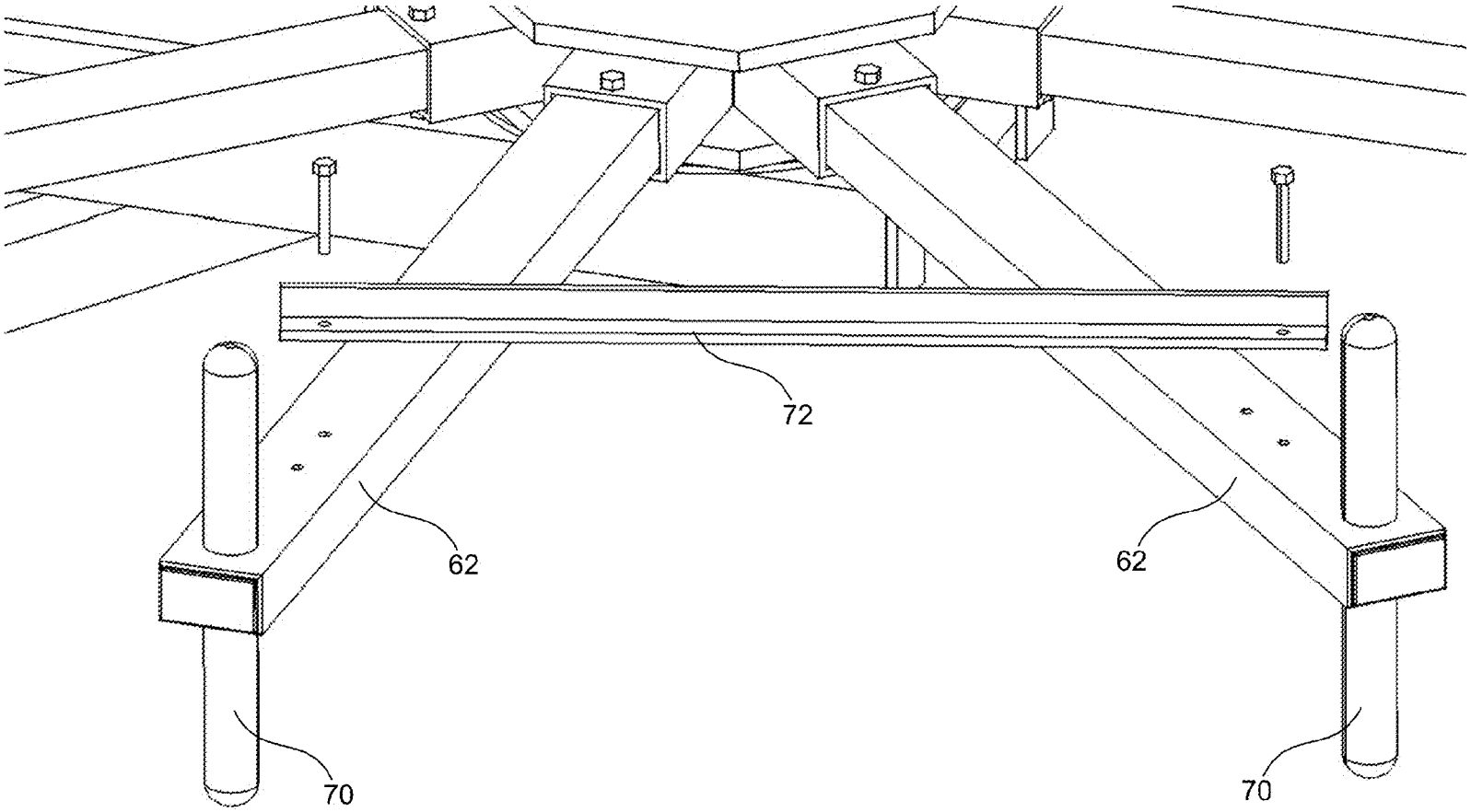
Figure 12:
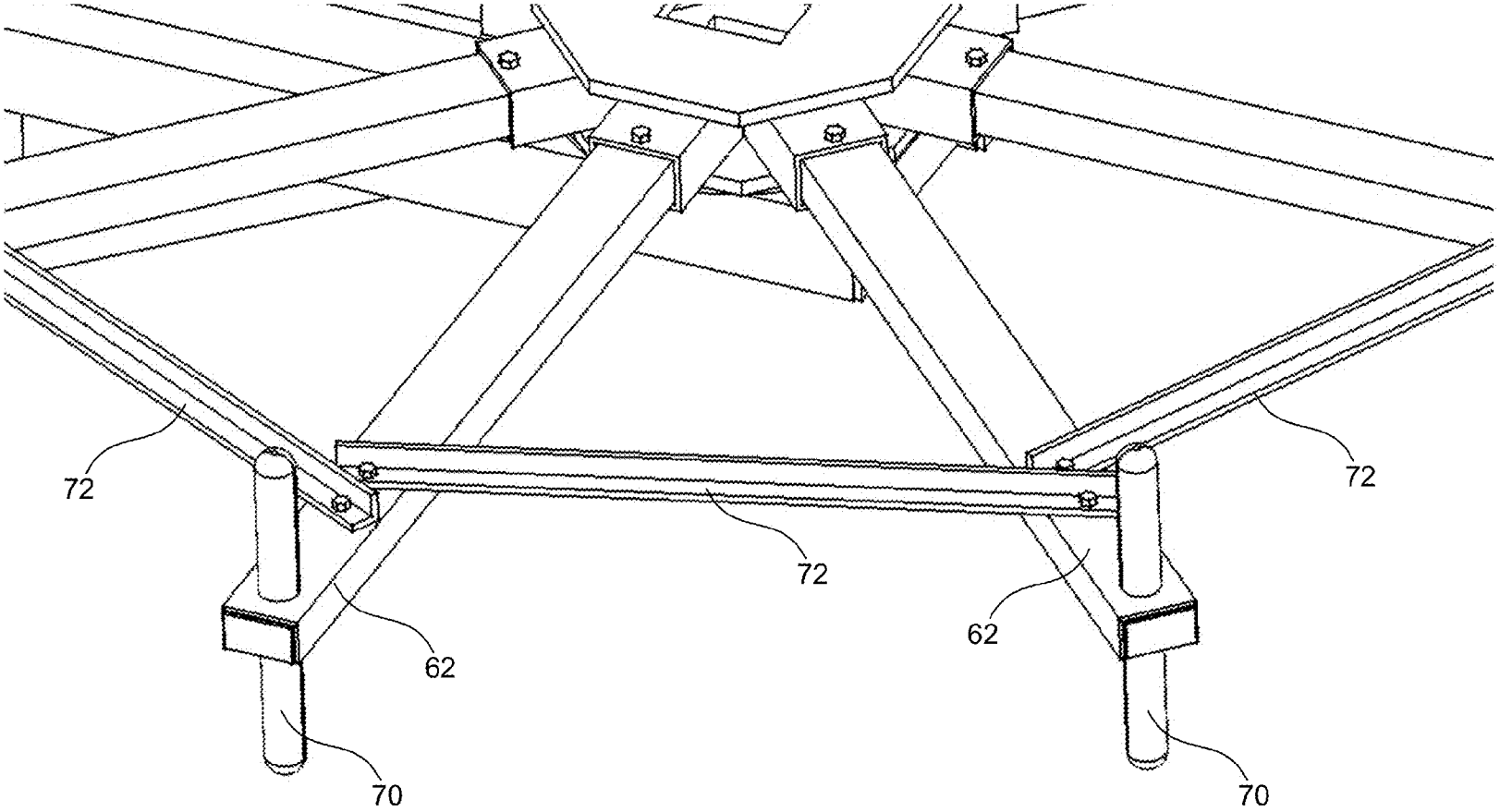
Figure 13:
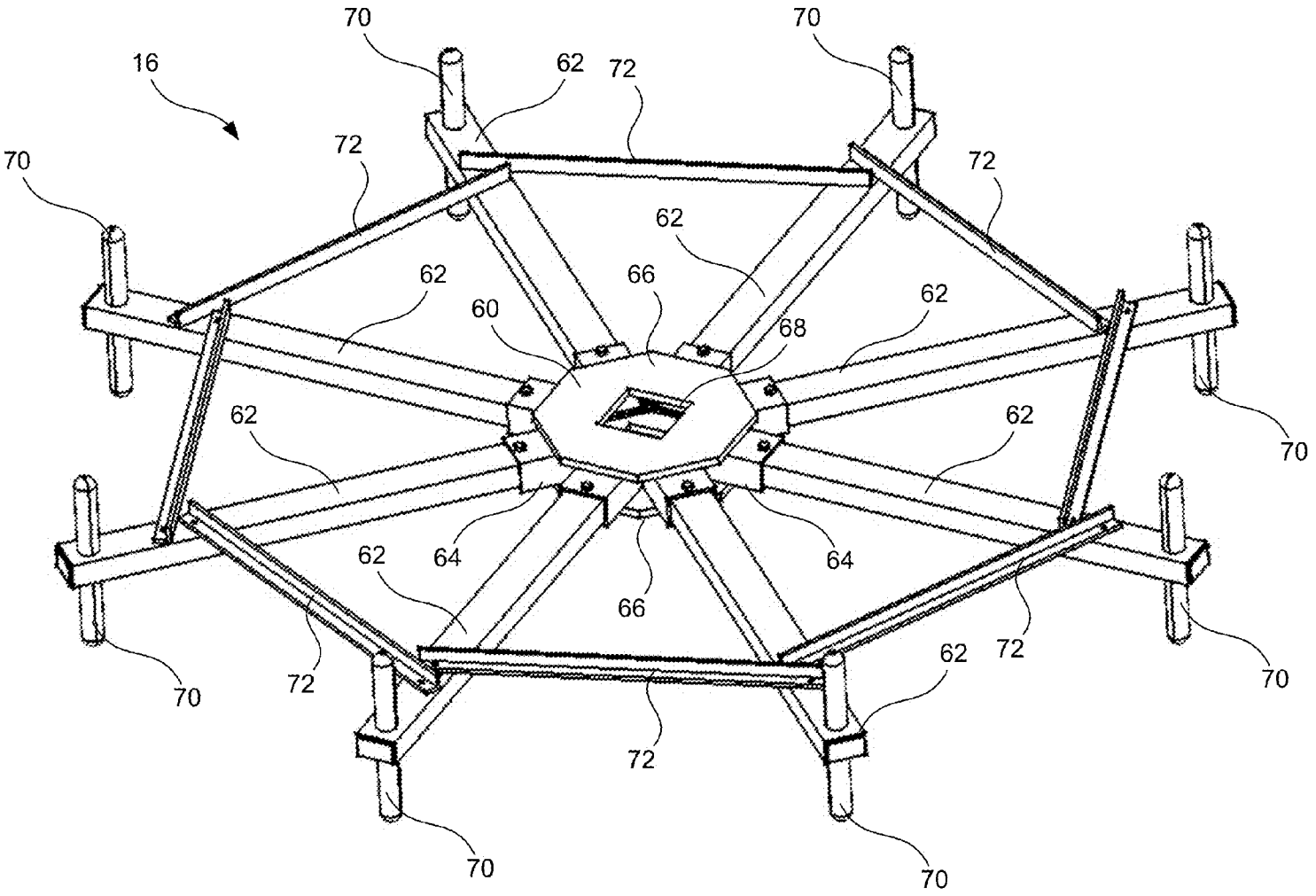
Figure 14:
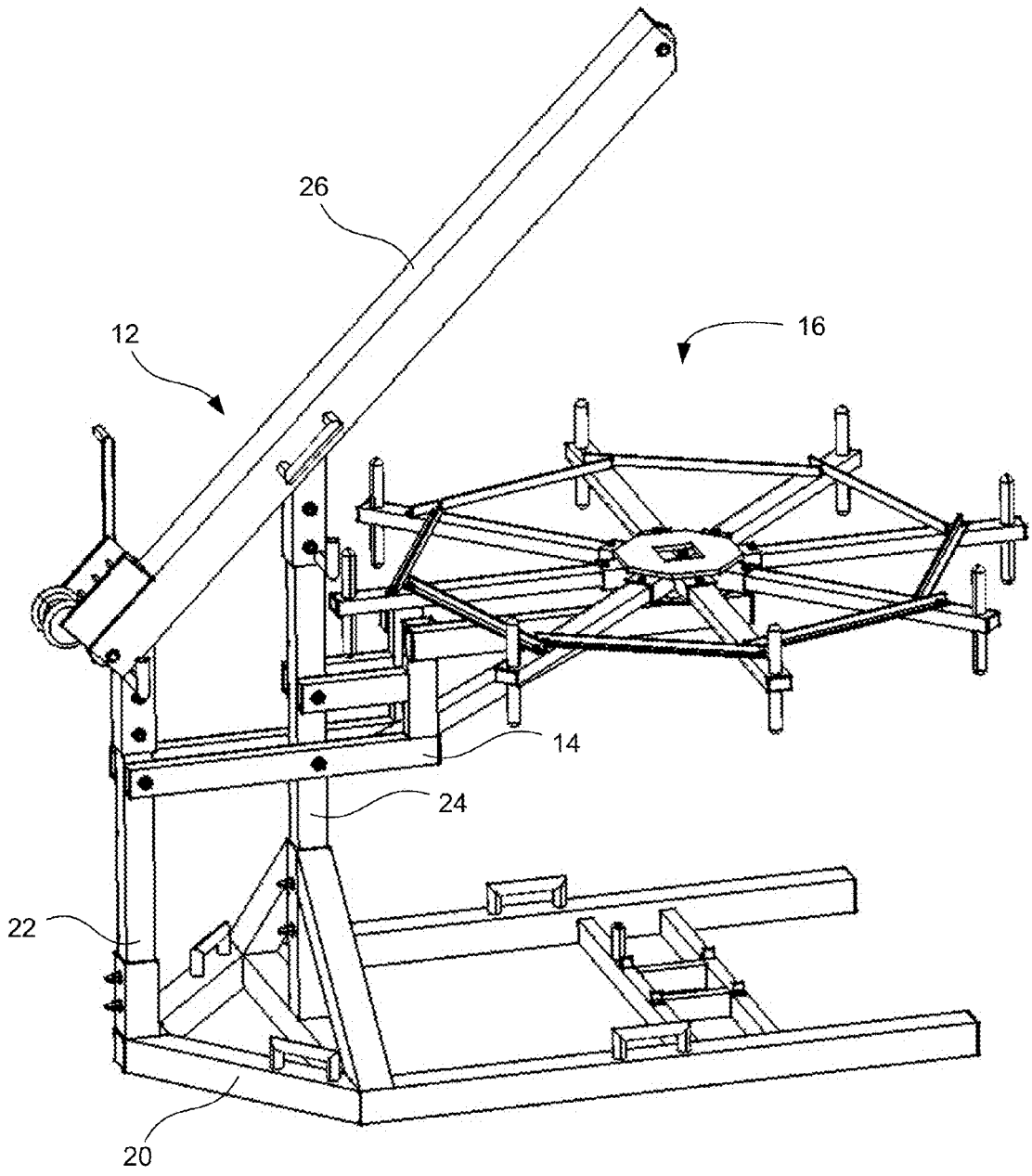
FIG. 14 shows the assembled wheel attached to the assembly of FIGS. 3-6.

Next, as illustrated in FIGS. 9-14, the wheel 16 is assembled. First, as shown in FIG. 9, the spokes 62 are inserted into the wheel hub and are secured as shown in FIG. 10. The cross braces 72 are then attached as shown in FIGS. 11-13 to complete the wheel 16. The wheel 16 is then checked to ensure it turns freely without interference or loose parts. When assembly of the wheel 16 is complete, the drill will appear as shown in FIG. 14.

Figure 15:
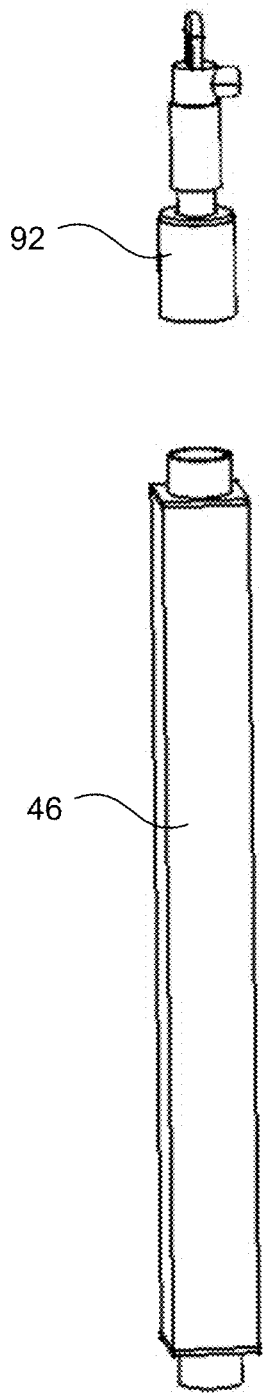
FIGS. 15-21 show steps for assembling a Kelly bar and pipe string to the assembly of FIG. 14 in preparation for drilling a borehole.
Figure 16:
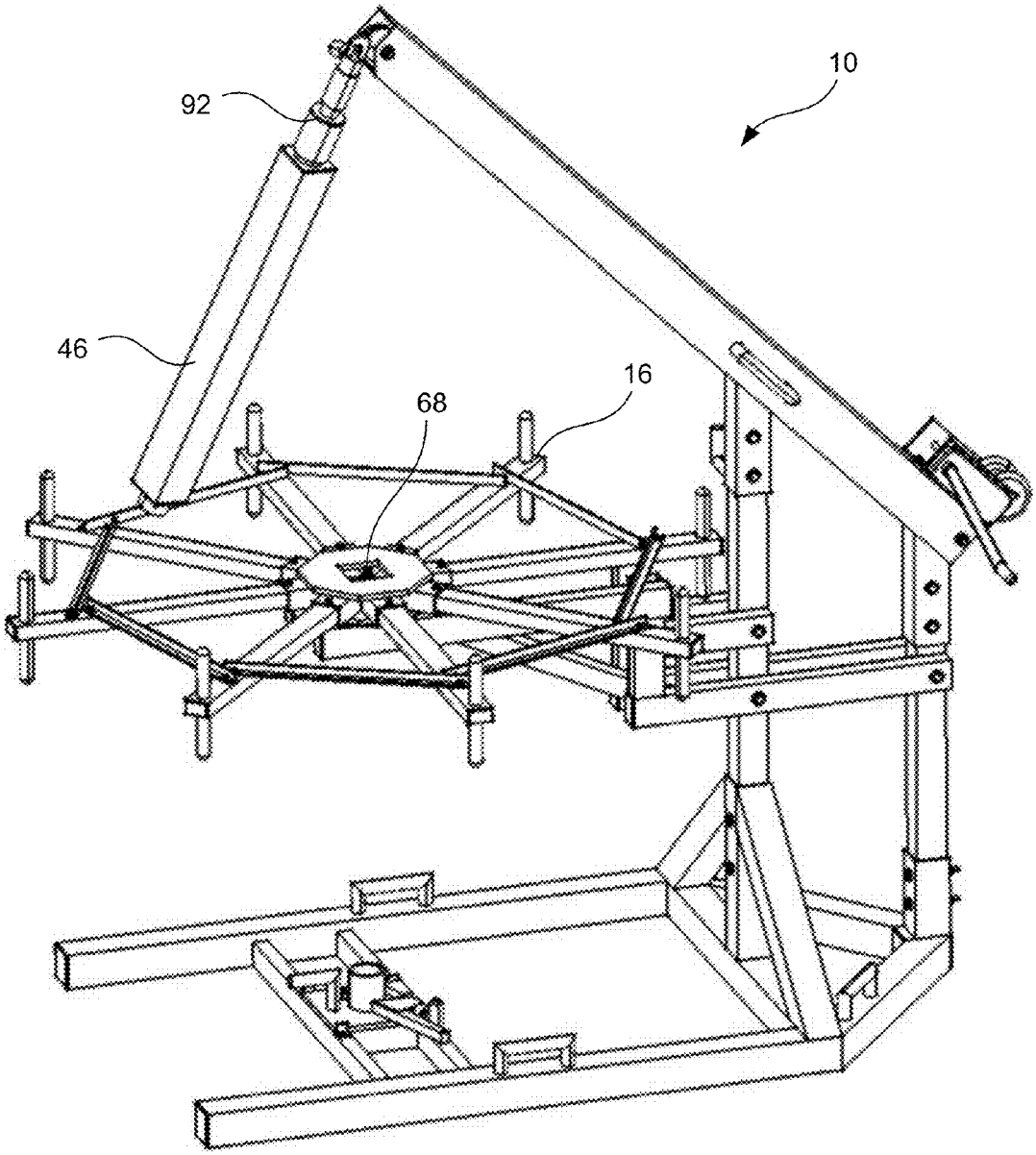
Figure 17:
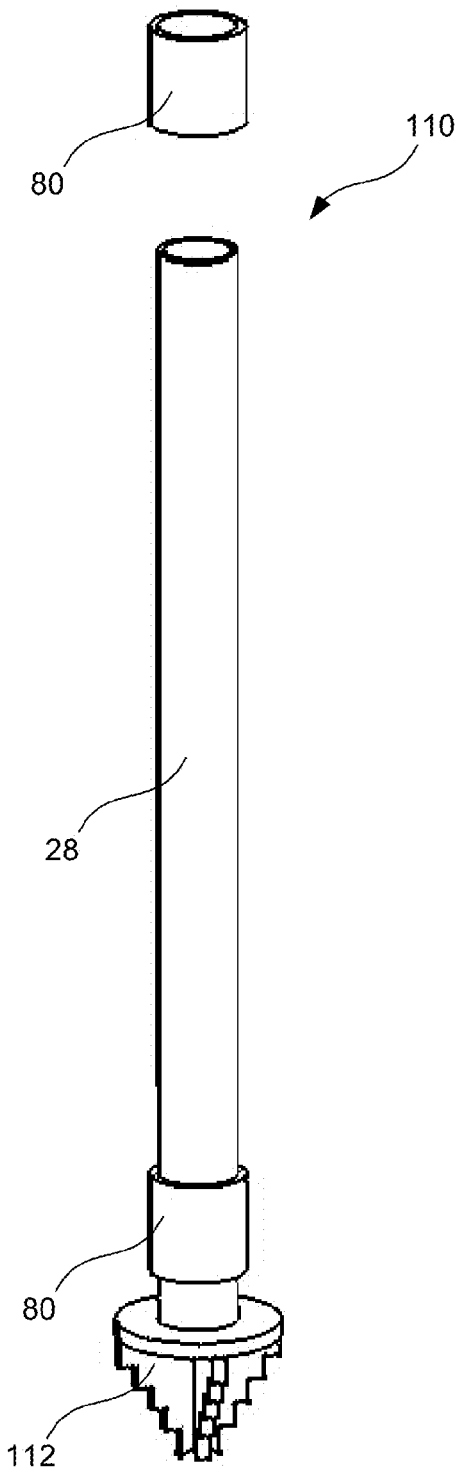

As is shown in FIG. 15, the swivel 92 is threaded onto the Kelly bar 46. The winch hook is then attached to the top of the swivel 92 as shown in FIG. 16 and the winch 44 is used to raise the Kelly bar 46 to its maximum height. The bottom of the Kelly bar 46 is then placed inside the square hole 68 of the wheel 16 while being kept at or near its maximum height. As shown in FIG. 17, the first segment 110 of the pipe string is assembled by ensuring that the first section of pipe 28 is securely connected to a drill bit 112 by one of the couplers 80. Another coupler 80 is then attached atop the section of the pipe 28.

Figure 18:
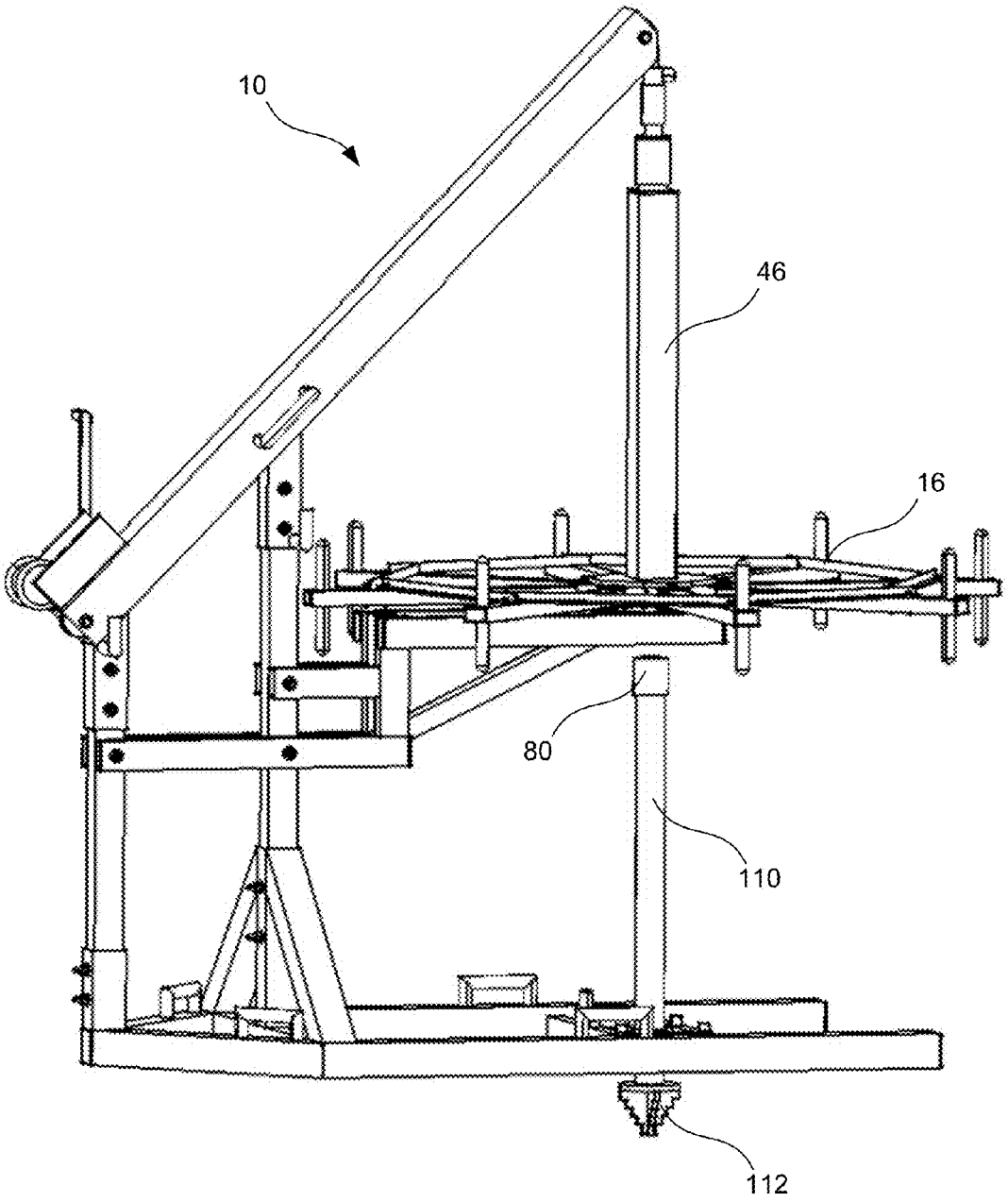
Figure 19:
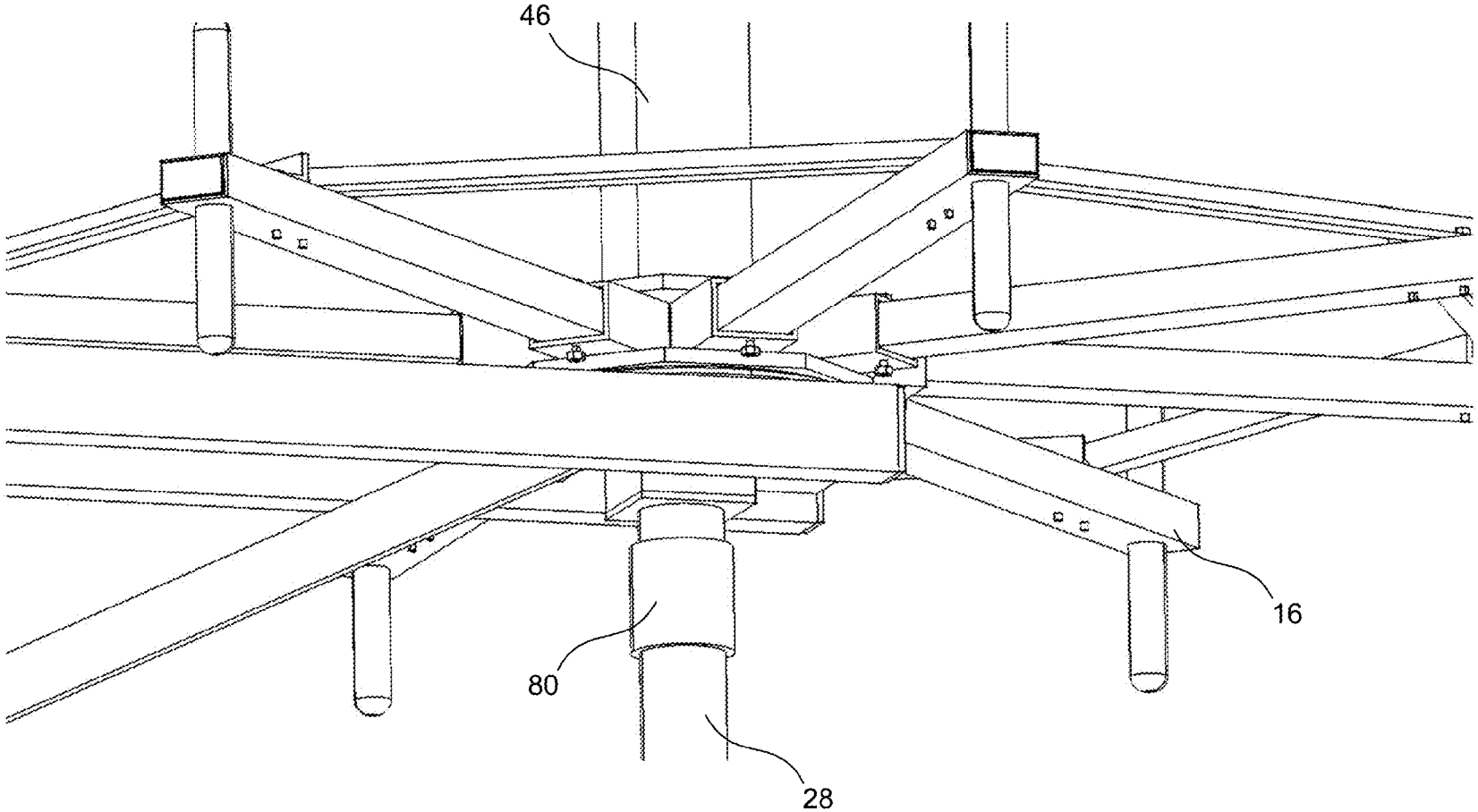
Figure 20:
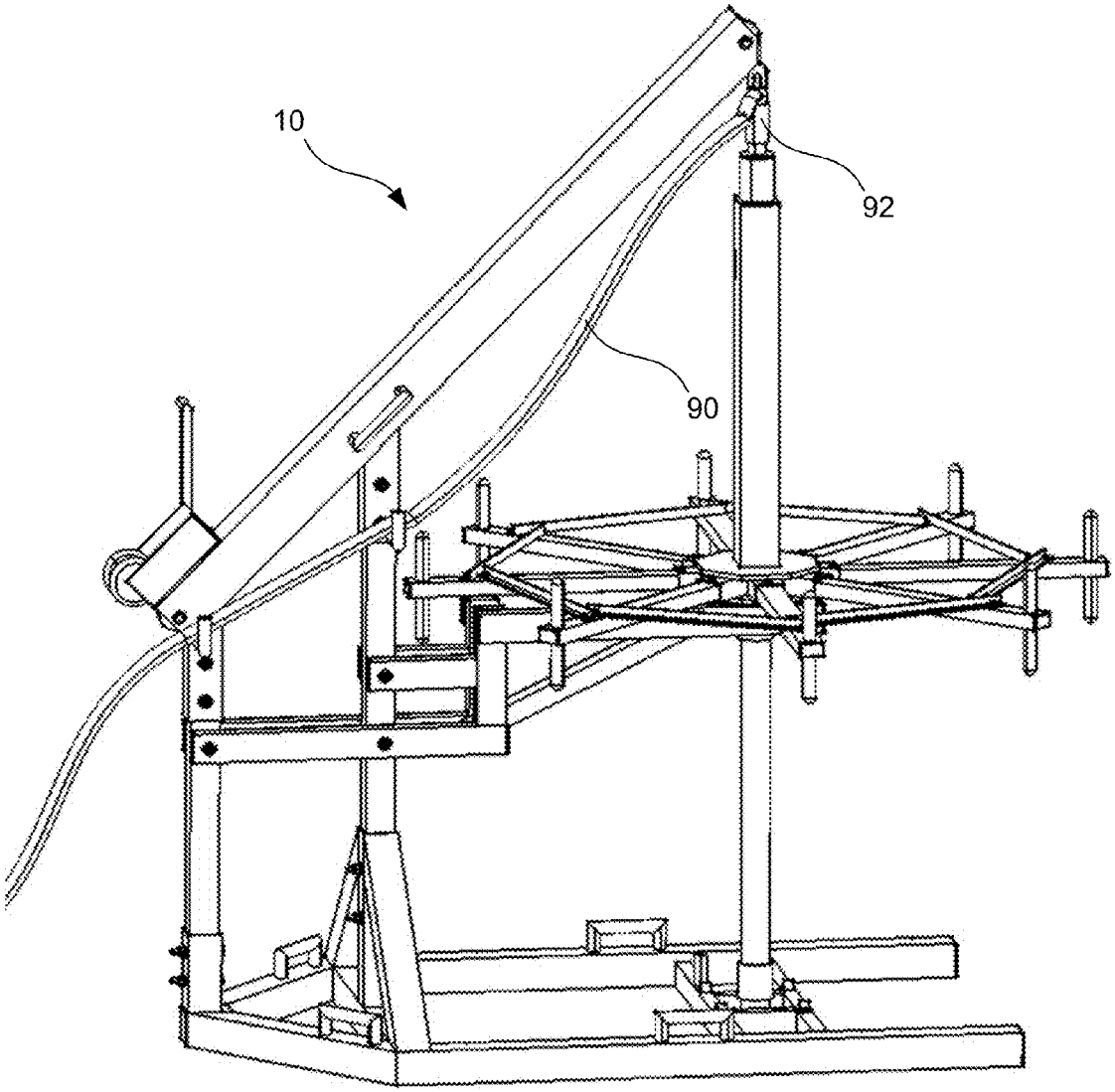
Figure 21:
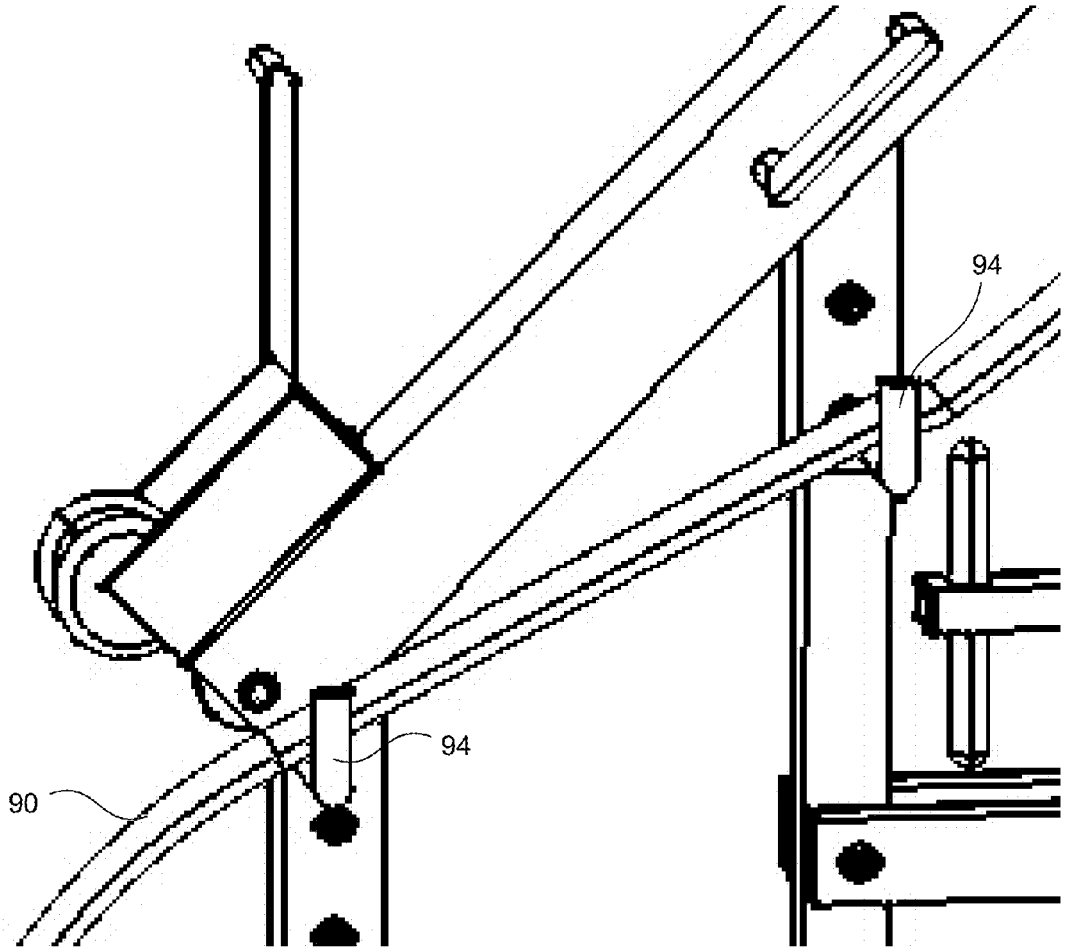
Figure 22:
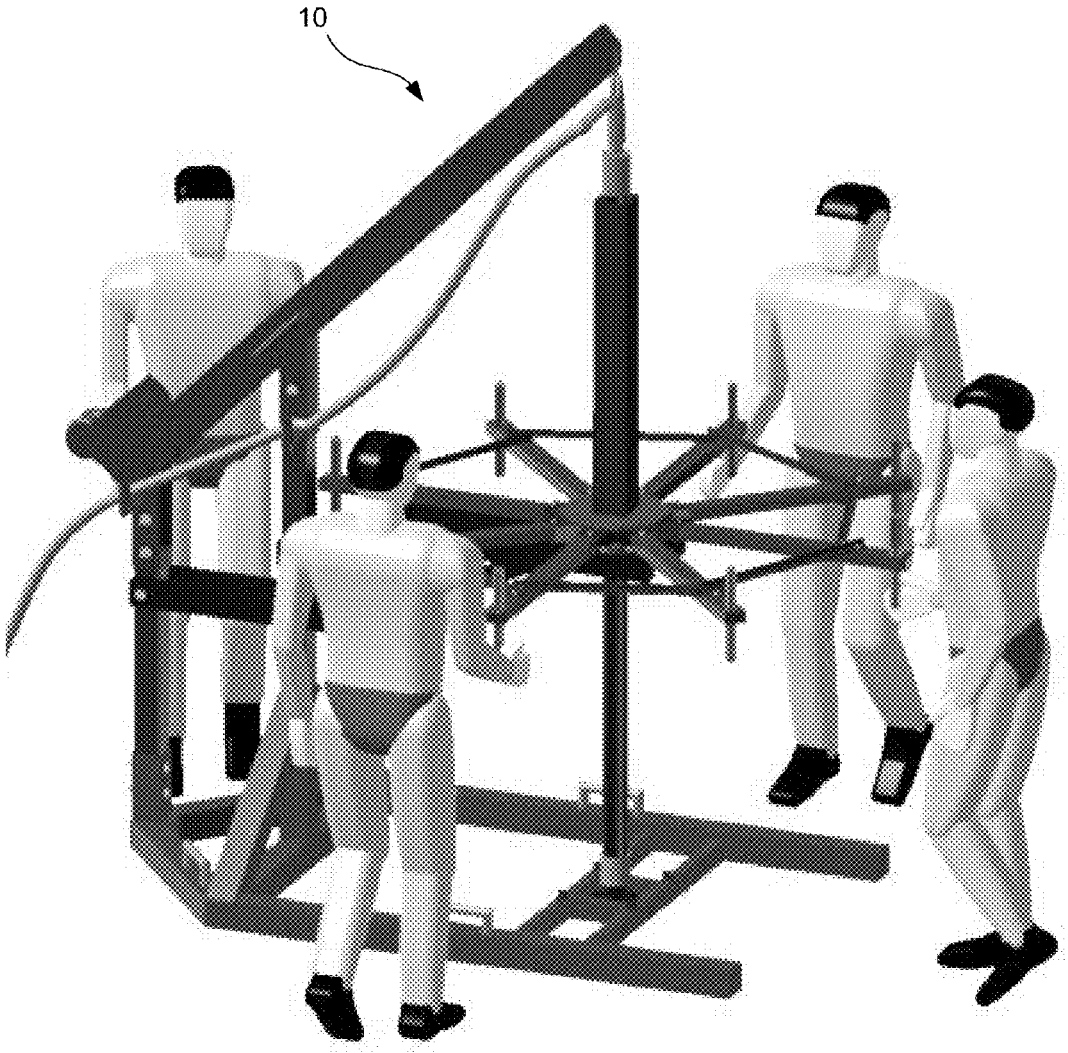
FIG. 22 shows a configuration of operators using the drill of FIGS. 1-21.

The first segment 110 of the pipe string is placed down into the pilot hole and is aligned underneath the Kelly bar as shown in FIG. 18. The Kelly bar and coupler 80 are then connected by first ensuring that the threads are engaged and then turning the wheel 16 clockwise while holding the drill pipe in place with the pipe wrench 82, as shown in FIG. 19. The winch 44 is used to slowly lower the Kelly bar while this is done. The pump hose 90 is then attached to the swivel 92 using the proper hose connections and while the pump is not running, as illustrated in FIG. 20. The pump hose 90 is rested on the hose hooks 94 as shown in FIG. 21. The drill 10 is then ready to be staffed by four workers as shown in FIG. 22, with one worker operating the winch 44 and three workers operating the wheel 16. Additional workers may operate the slurry pump, clear the trenches 102 and basins 104, and may ensure that sufficient slurry is prepared and available. The workers may rotate through their positions from time to time as drilling proceeds for rest purposes.

The slurry pump should always be running before beginning to spin the wheel 16 to drill. Thus, the pump is run and the worker ensures that slurry comes out the bottom of the drill bit 112. At later stages, the worker ensures that slurry is rising in the borehole. Any leaks in the hose connections are fixed, then the wheel 16 is spun clockwise at a comfortable rate, such as thirty rotations per minute. Safety is ensured by keeping hands and arms out of the path of the spokes 52 and rods 70. Meanwhile, the operator of the winch 44 uses it to slowly lower the pipe string at a rate that allows the wheel 16 to continue to spin freely from the inertia of the wheel 16.

Controlling the descent of the pipe string helps ensure efficient drilling: if the wheel 16 stops immediately after being released, the pipe string should be pulled up using the winch 44 until the wheel 16 spins freely again. When the descent rate is too quick, the drill bit 112 becomes buried in the bottom of the borehole and will become difficult to turn, while a proper slow rate allows the slurry to flush excavated material away so the drill bit 112 does not become buried at the bottom of the borehole. If rock or harder soil is encountered, it may be necessary to allow the drill bit 112 to fully rest on the bottom to grind away the rock or harder soil, and the wheel 16 will become harder to turn.

Figure 23:
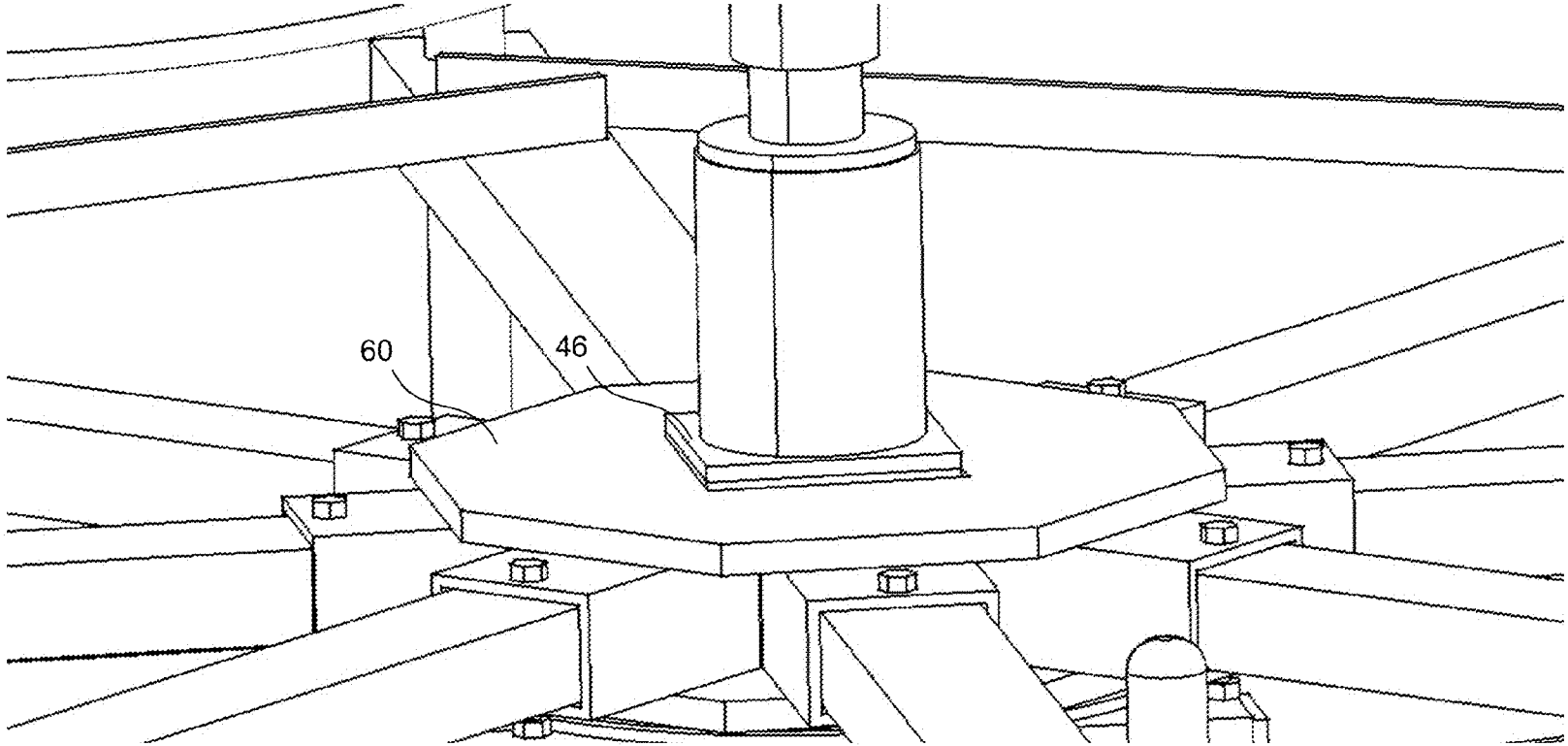
FIGS. 23-30 show steps for drilling a borehole and for adding an additional pipe segment to the pipe string.
Figure 24:
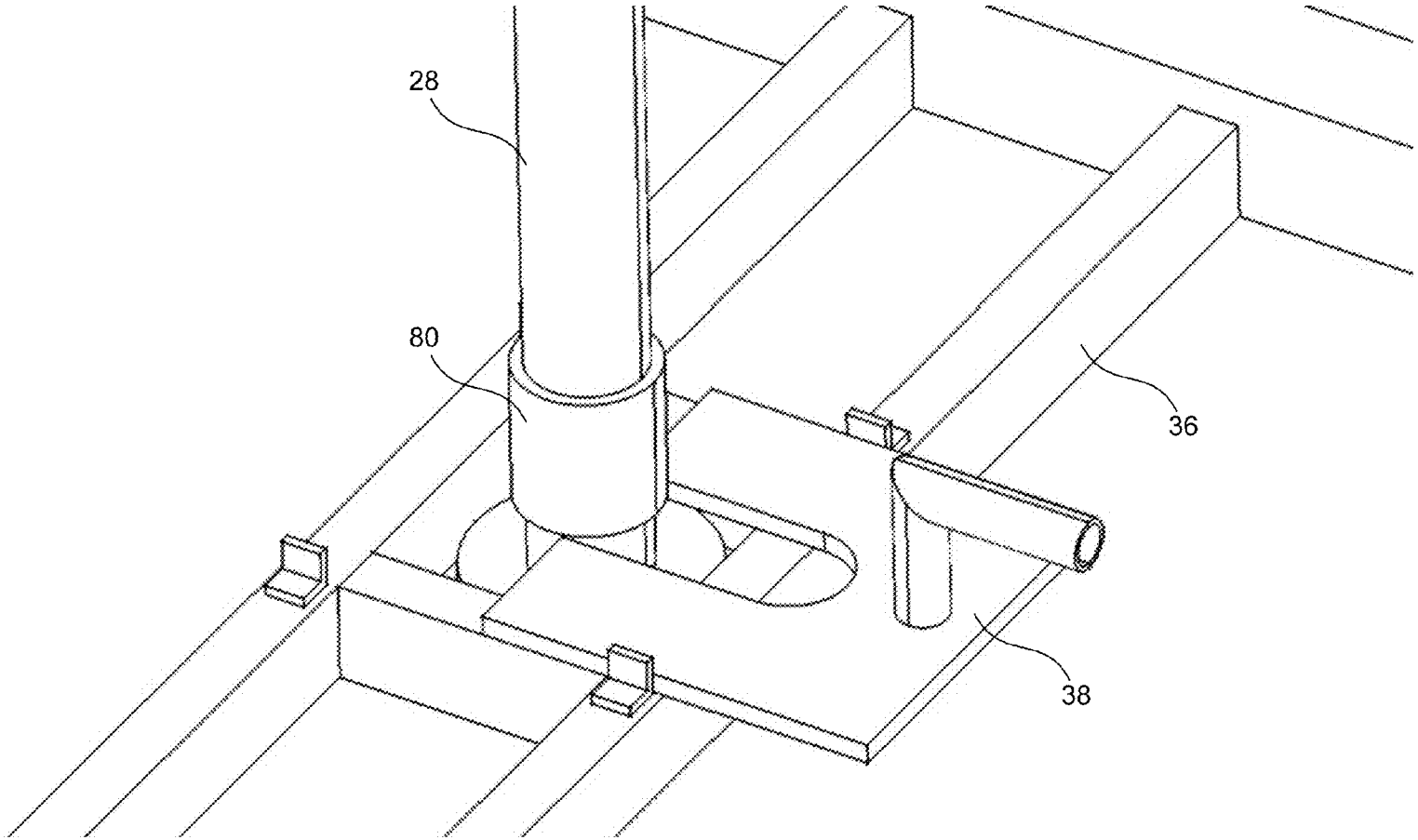

Drilling continues until the top of the Kelly bar 46 is approximately flush with the top of the wheel hub 60 as shown in FIG. 23. In loose soil, this may take approximately two minutes. The winch 44 is then used to raise the pipe string slightly, until the slip plate 38 will fit under the bottom coupler 80 as shown in FIG. 24. The slurry pump is then run for another three to five minutes without spinning the wheel 16 to flush out all cuttings.

Figure 25:
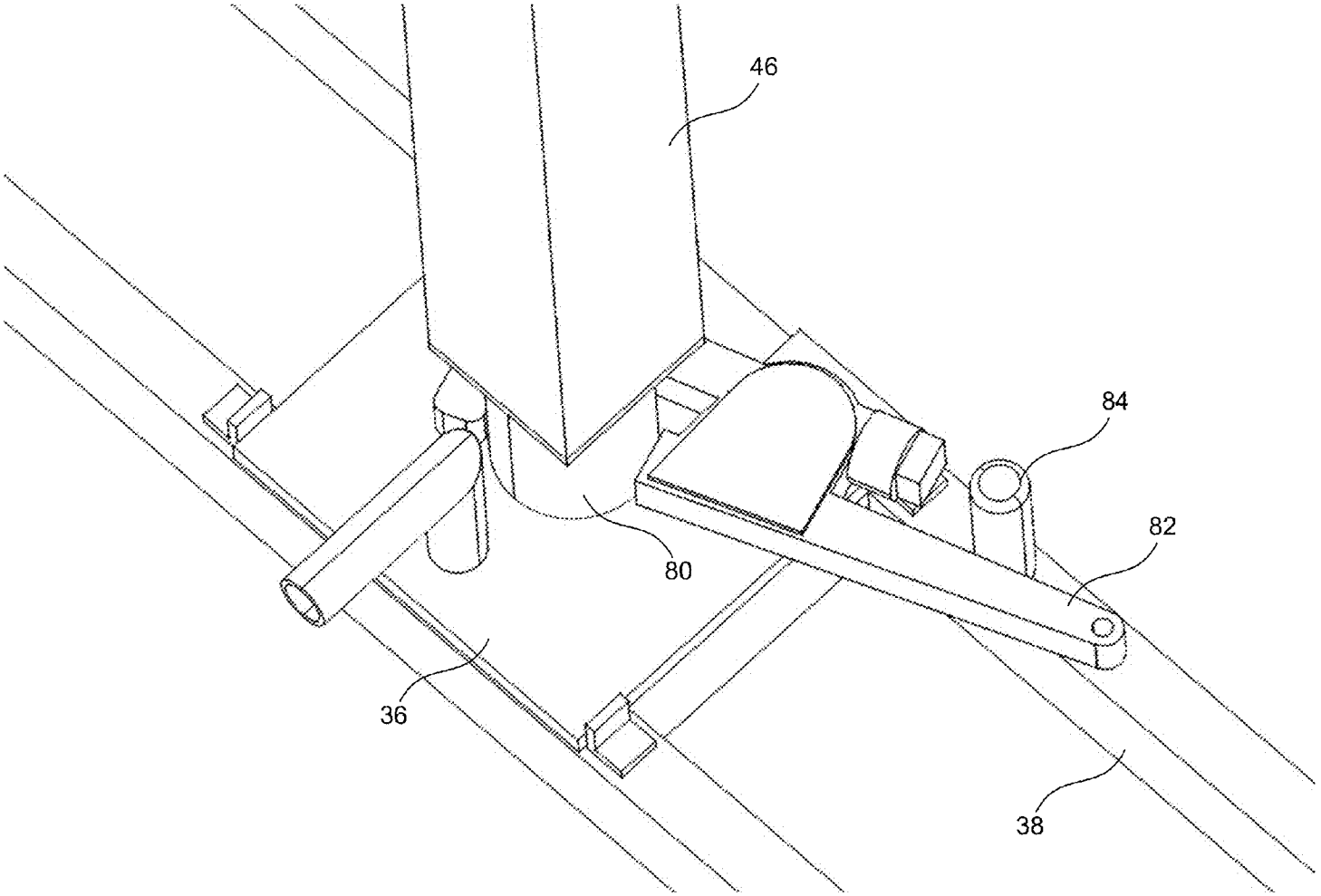
Figure 26:
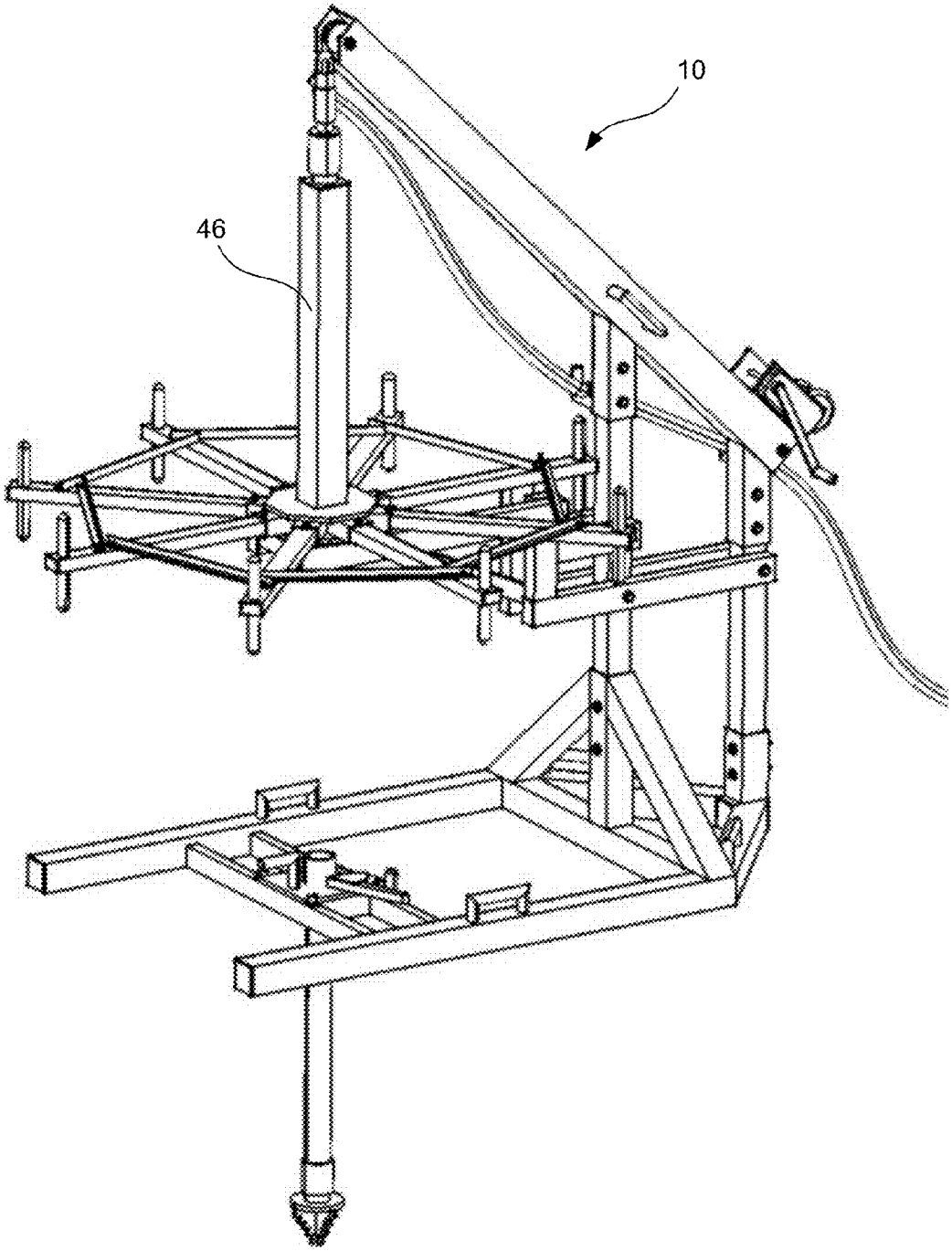

After the cuttings are flushed, the slurry pump is stopped, and the pipe wrench 82 is snugged around the coupler 80 as shown in FIG. 25. The assembly is turned until the wrench 82 rests against the wrench stop 84 as shown, then the wheel 16 is turned counterclockwise to unthread the Kelly bar 46 from the coupler 80 and pipe string in the hole. The wheel 16 may be harder to turn than when drilling, and the winch 44 can be used to slowly raise the Kelly bar 46 as it unthreads. Once unthreading is complete, the winch 44 is used to raise the Kelly bar 46 to its maximum height as shown in FIG. 26.

Figure 27:
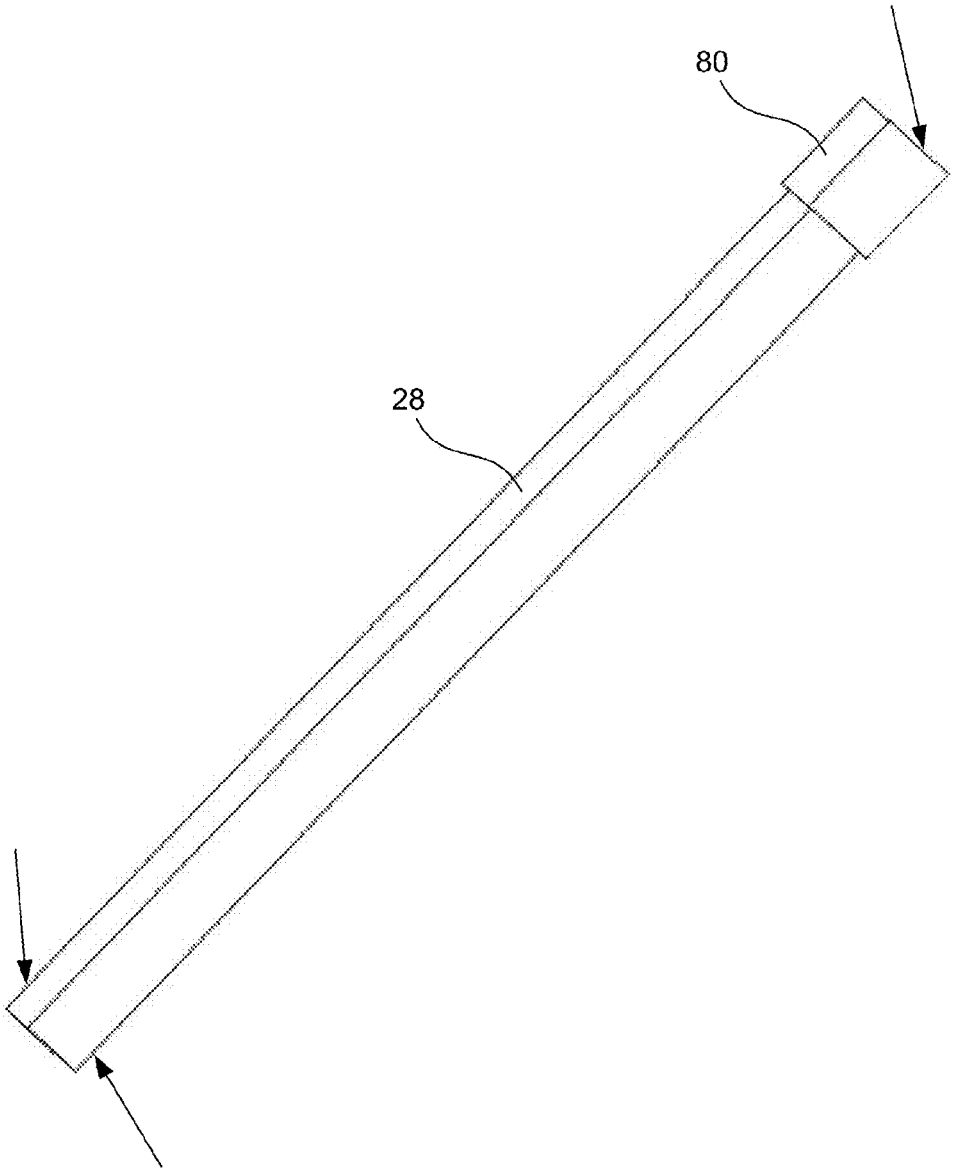
Figure 28:
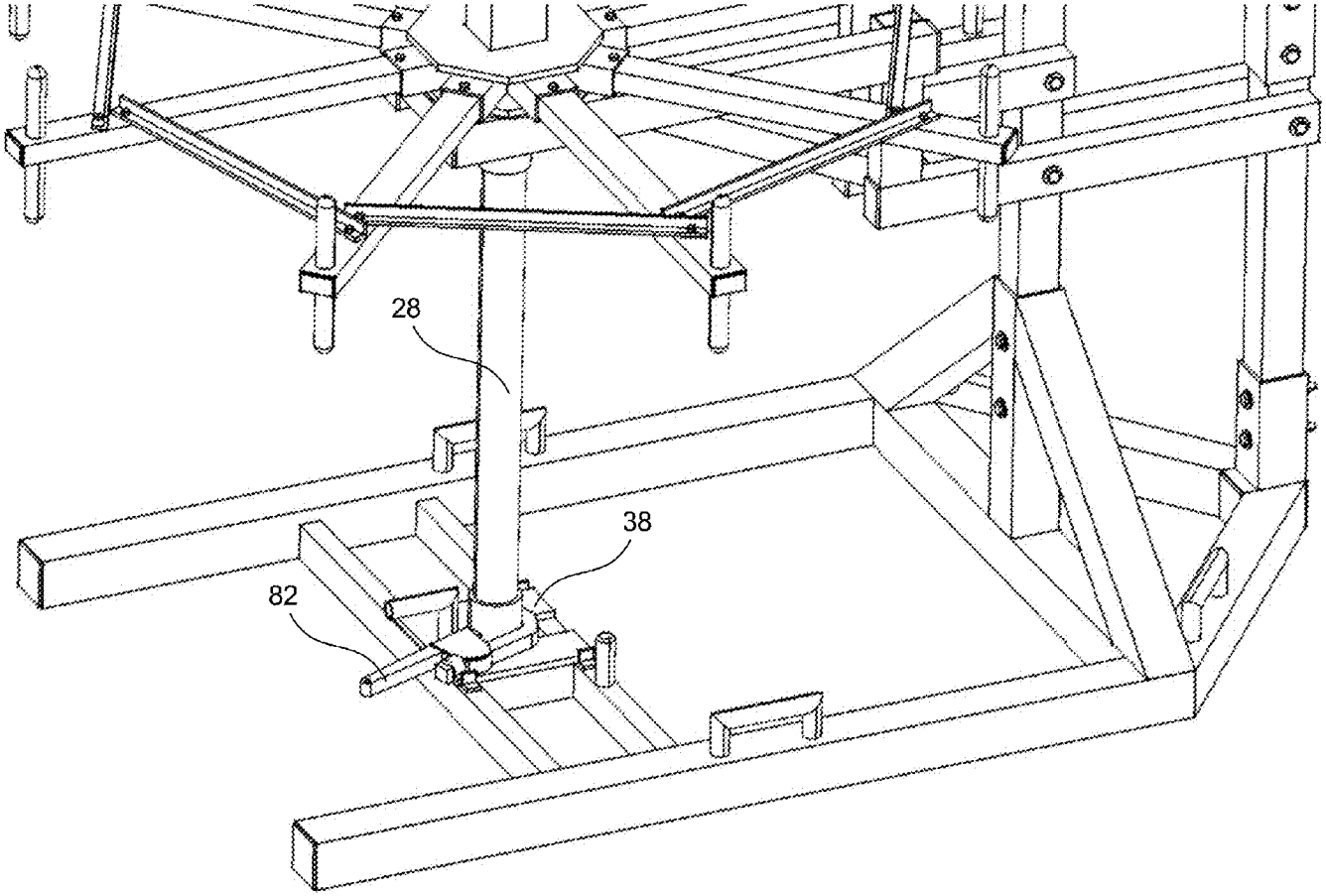
Figure 29:
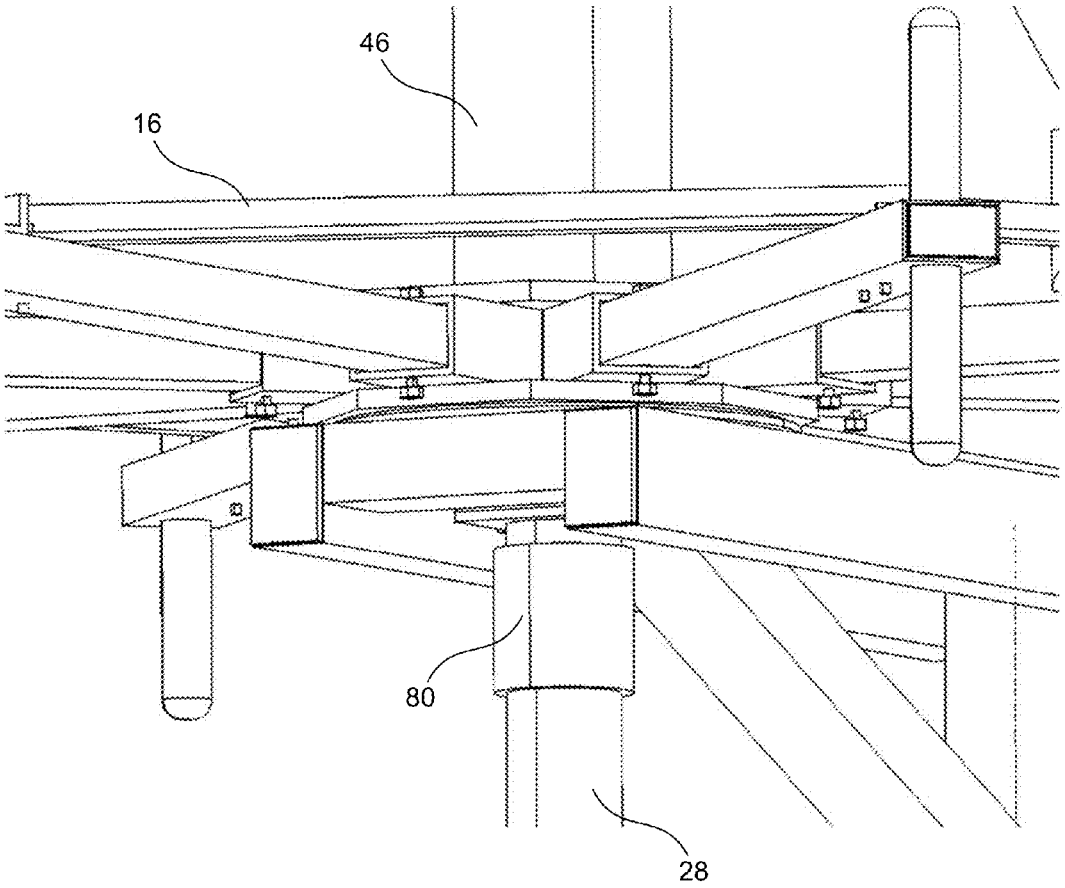
Figure 30:
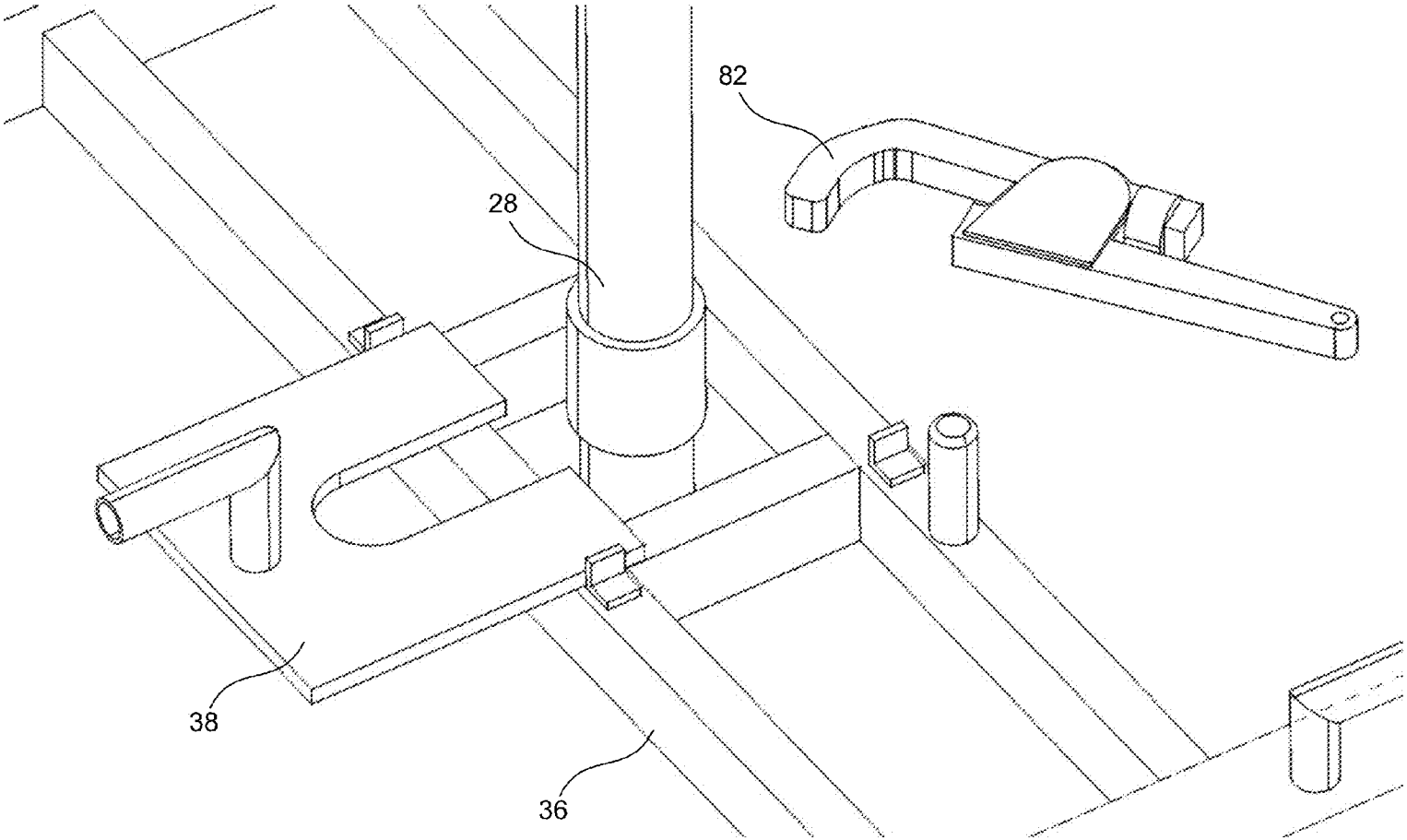

A new segment of pipe 28 is prepared by attaching a coupler 80 to one end and by generously spreading thread grease on the open threads of the pipe 28 and inside the coupler 80 as indicated in FIG. 27. The new segment of pipe 28 is inserted into the coupler 80 resting on the slip plate 38, and the new segment of pipe 28 is gently threaded into the coupler by hand, ensuring that the threads align, as shown in FIG. 28. The winch 44 is then used to lower the Kelly bar until it rests on top of the newly added segment of pipe 28, as shown in FIG. 29. The wheel 16 is then carefully (to avoid stripping the threads) turned clockwise while slowly lowering the Kelly bar 46 with the winch to thread the Kelly bar into the coupler 80 of the new segment of pipe 28. Then, as shown in FIG. 30, the wrench 82 and slip plate 38 are removed (the winch 44 may be used to raise the pipe string slightly if necessary), the slurry pump is reengaged and the flow of slurry checked, and drilling can continue as before.

When the desired borehole depth is reached (measured by the number of segments of pipe 28 that have been added to the pipe string multiplied by the segment length), the pump is left running for ten to fifteen minutes to flush all cuttings from the borehole. Then, the slurry pump is no longer needed, and the pipe string can be removed from the borehole as will be illustrated in FIGS. 31-42. As all components referred to in FIGS. 31-42 have been previously labeled and discussed, they are not shown in FIGS. 31-42.

Figure 31:
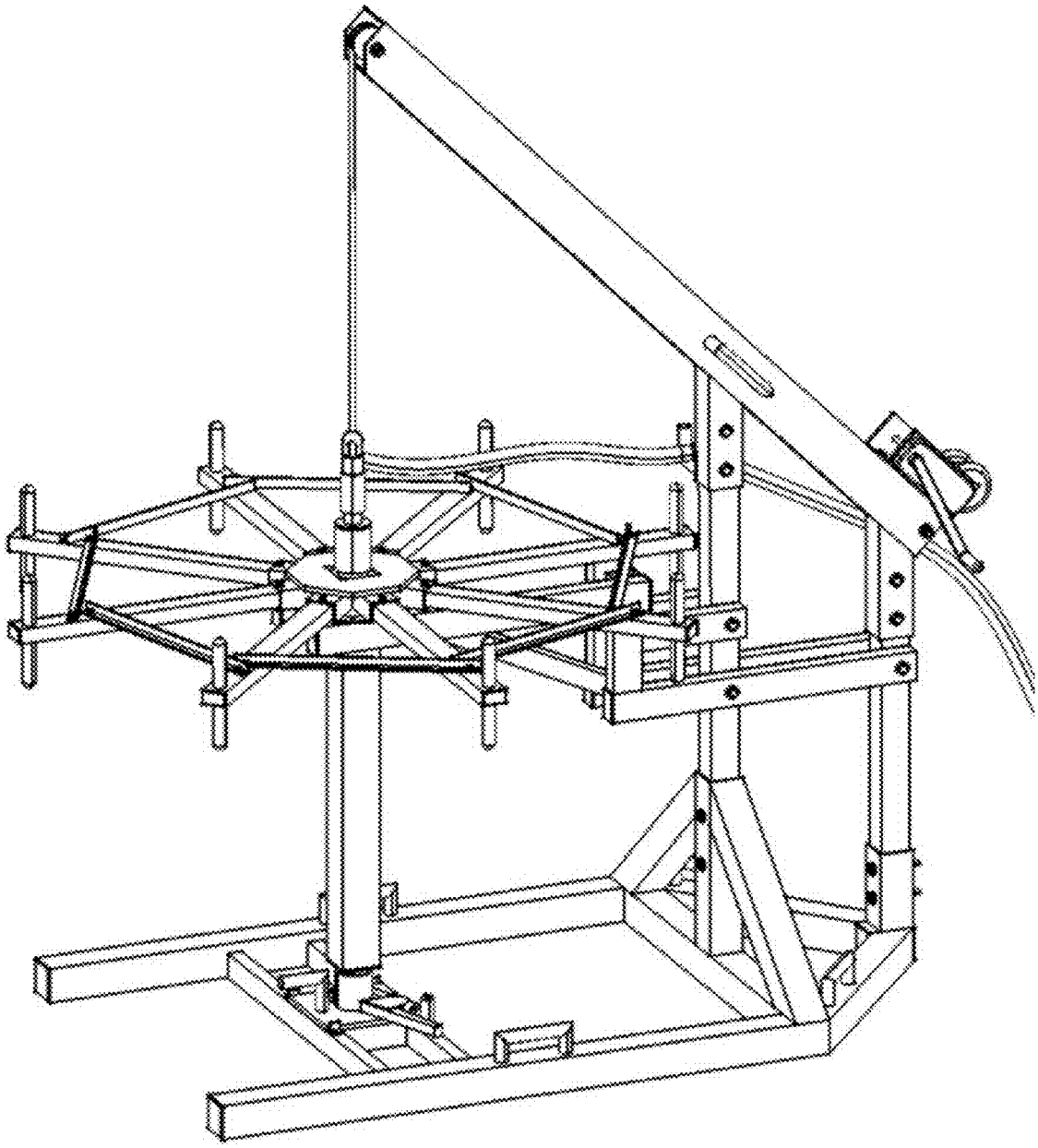
FIGS. 31-42 show steps for disassembling the drill and removing the pipe string when the borehole is complete.
Figure 32:
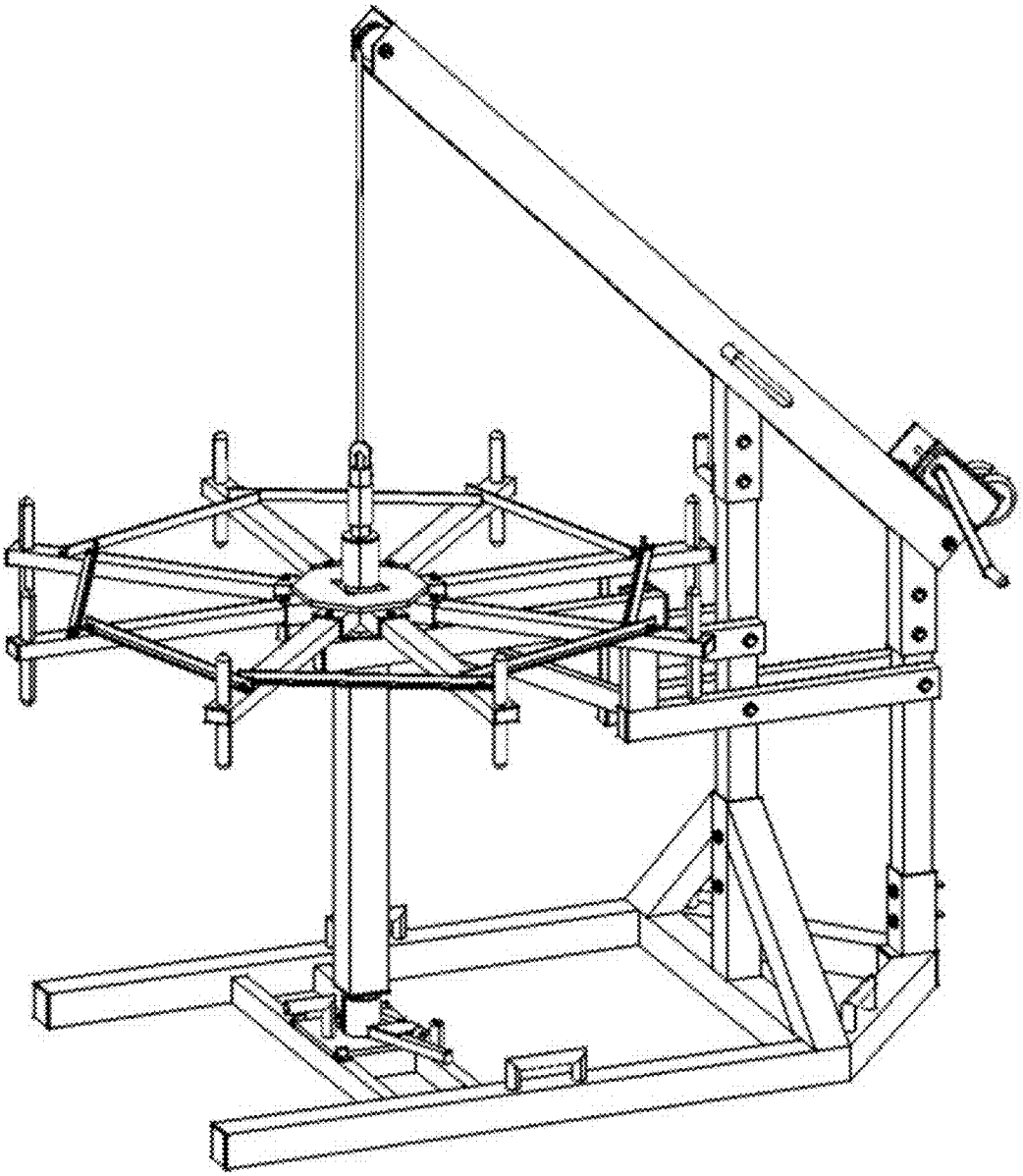
Figure 33:
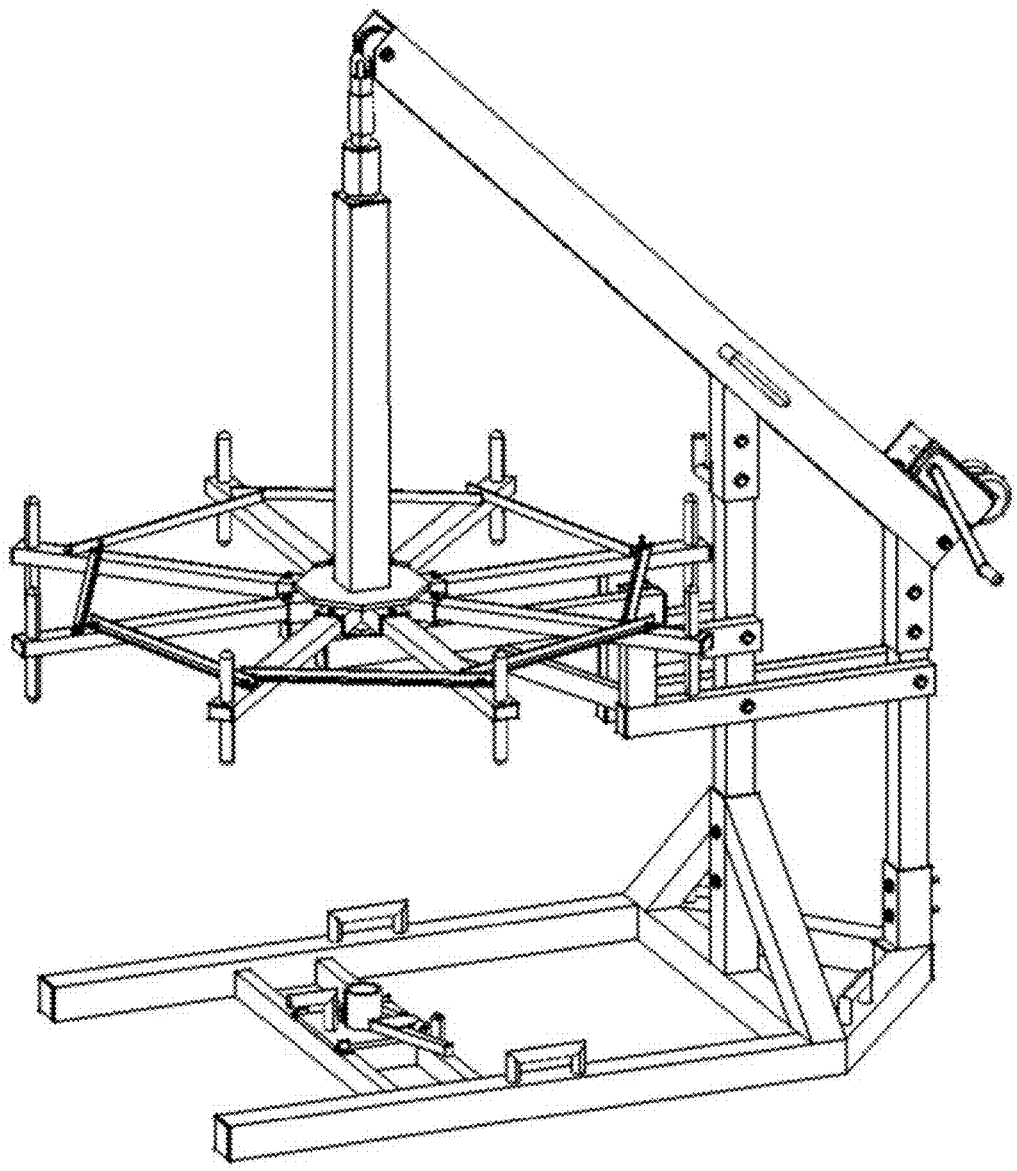
Figure 34:
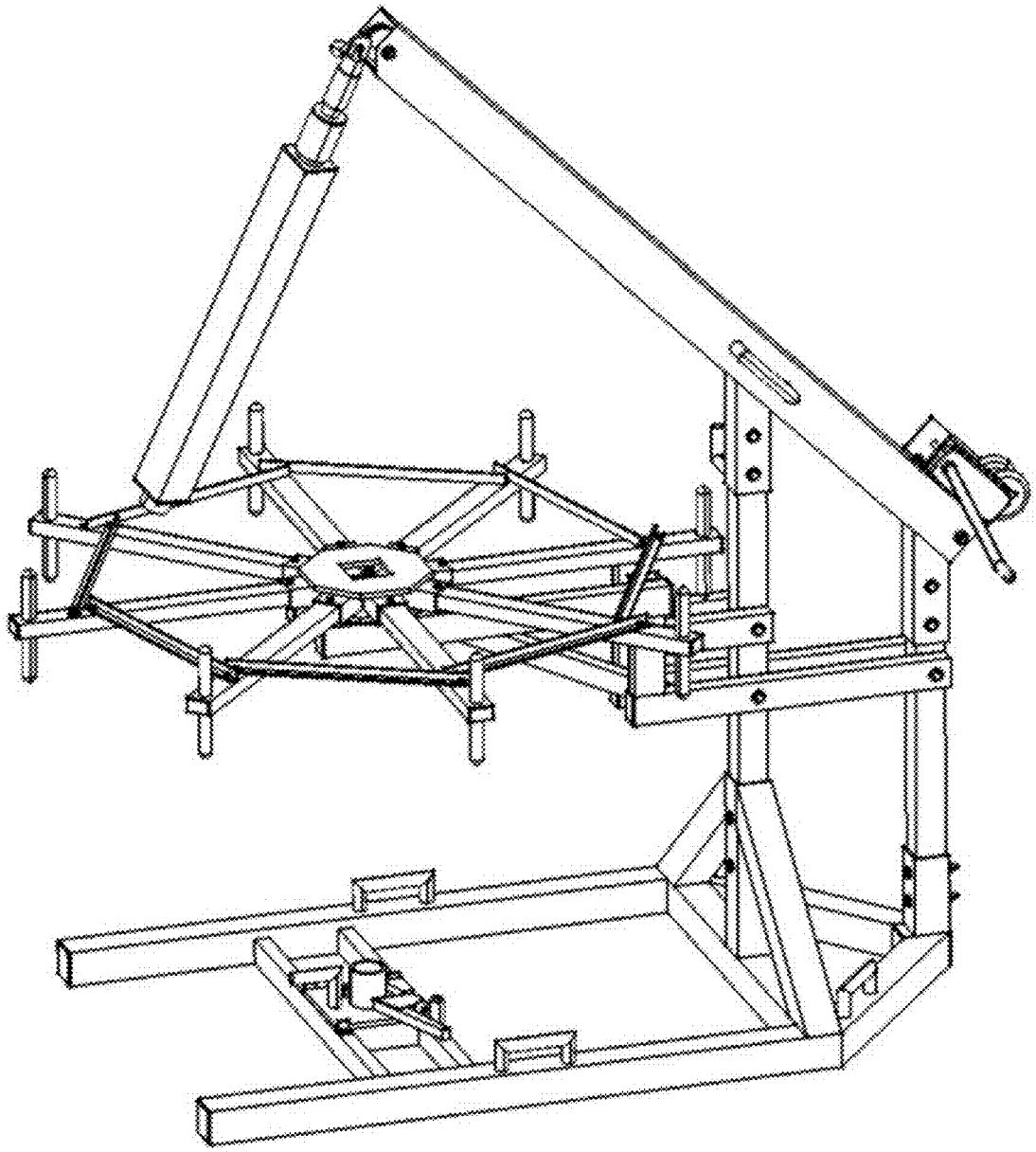
Figure 35:
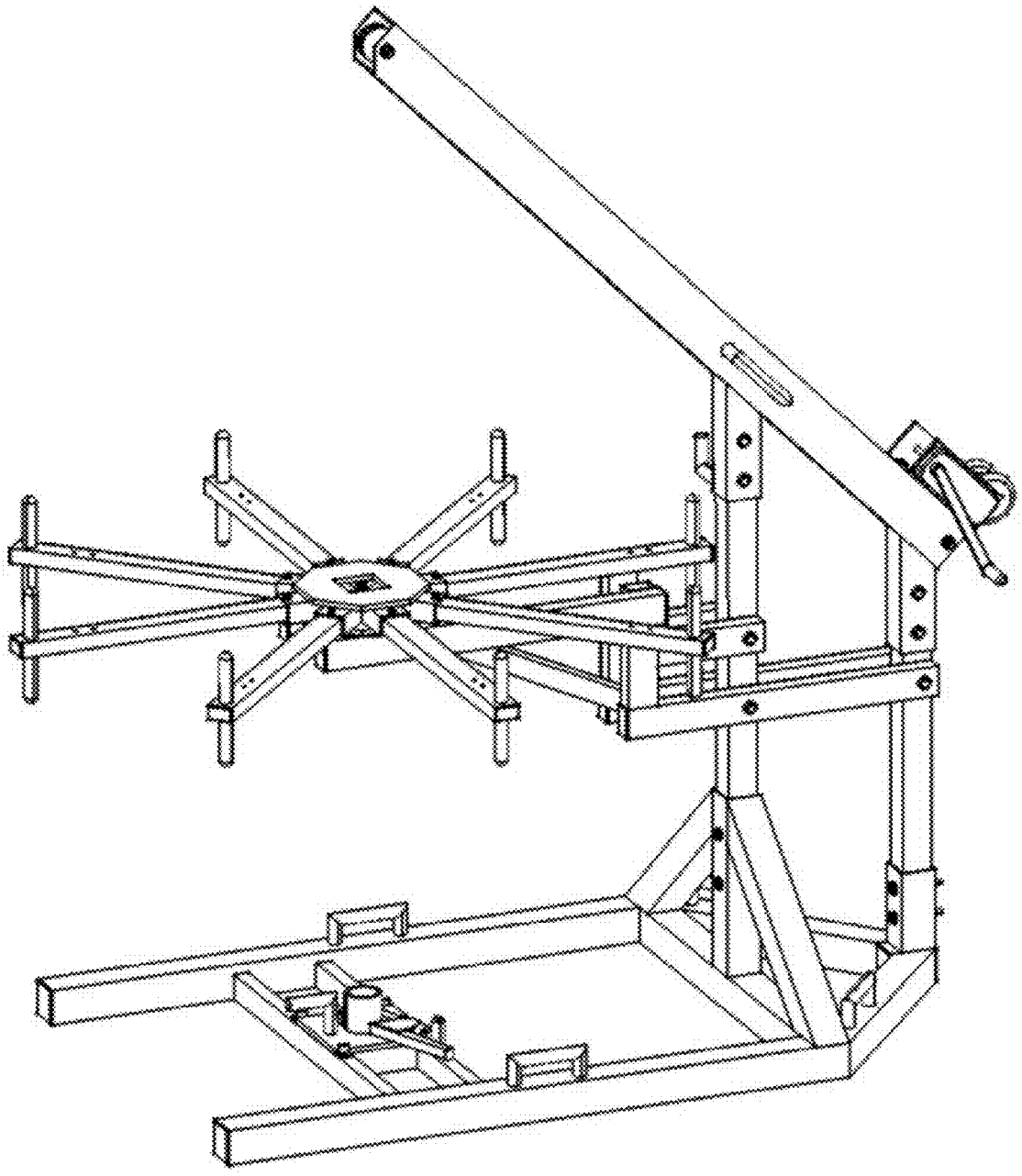
Figure 36:
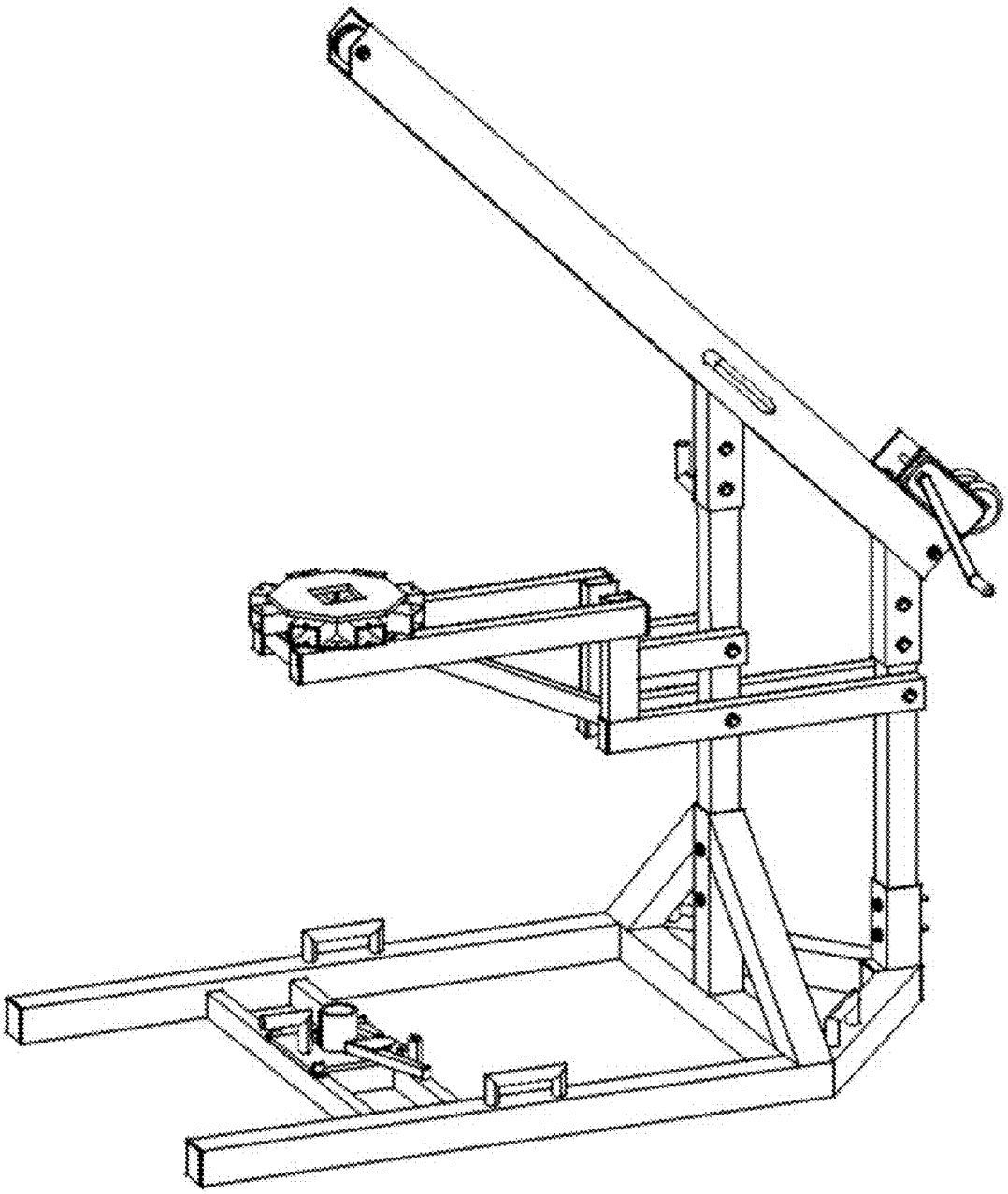
Figure 37:
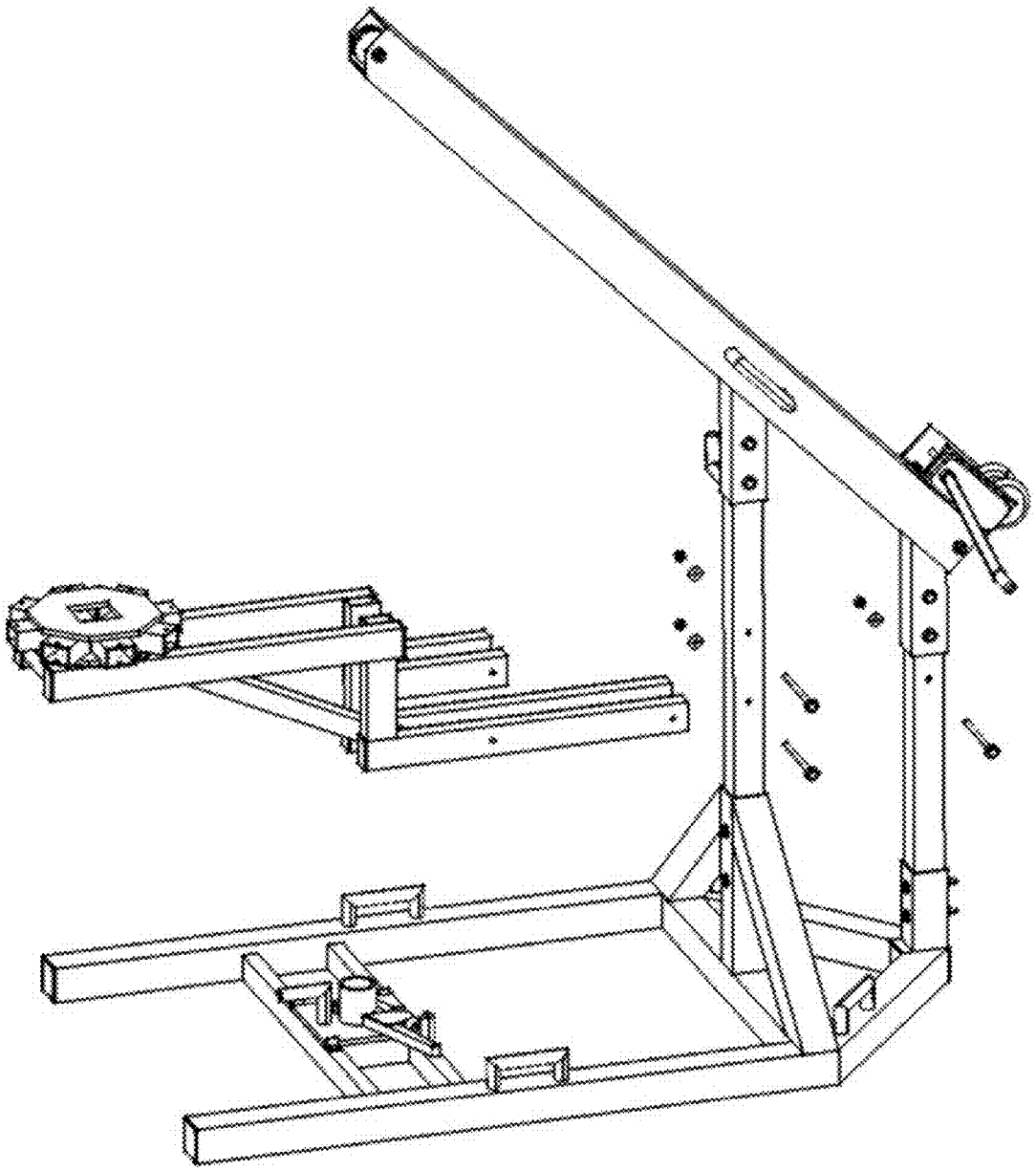

The pipe string removal process occurs first by using the winch 44 to lift the pipe string until the slip plate 38 and wrench 82 can be positioned as shown in FIG. 31. Then the pump hose 90 is removed from the swivel 92 and hose hooks 94 as shown in FIG. 32. The Kelly bar 46 is unthreaded from the pipe string by turning the wheel 16 counterclockwise, then the winch 44 is used to raise the Kelly bar 46 to its maximum height as shown in FIG. 33. The Kelly bar is then removed as shown in FIG. 34. As shown in FIGS. 35-37, the cross braces 72, spokes 62, and wheel support 14 are subsequently removed (or can be removed together if the weight is not excessive compared to the available manpower).

Figure 38:
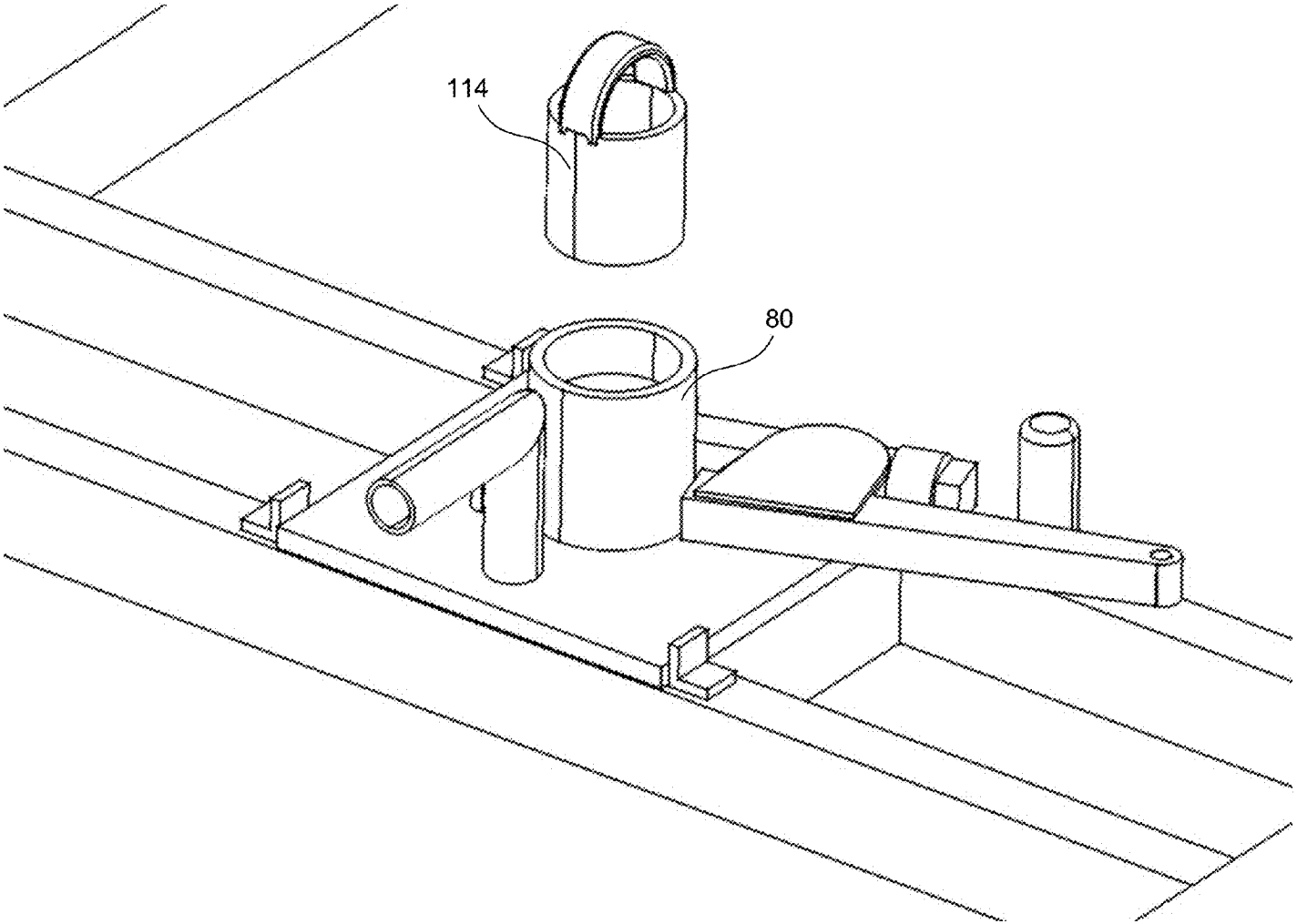
Figure 39:
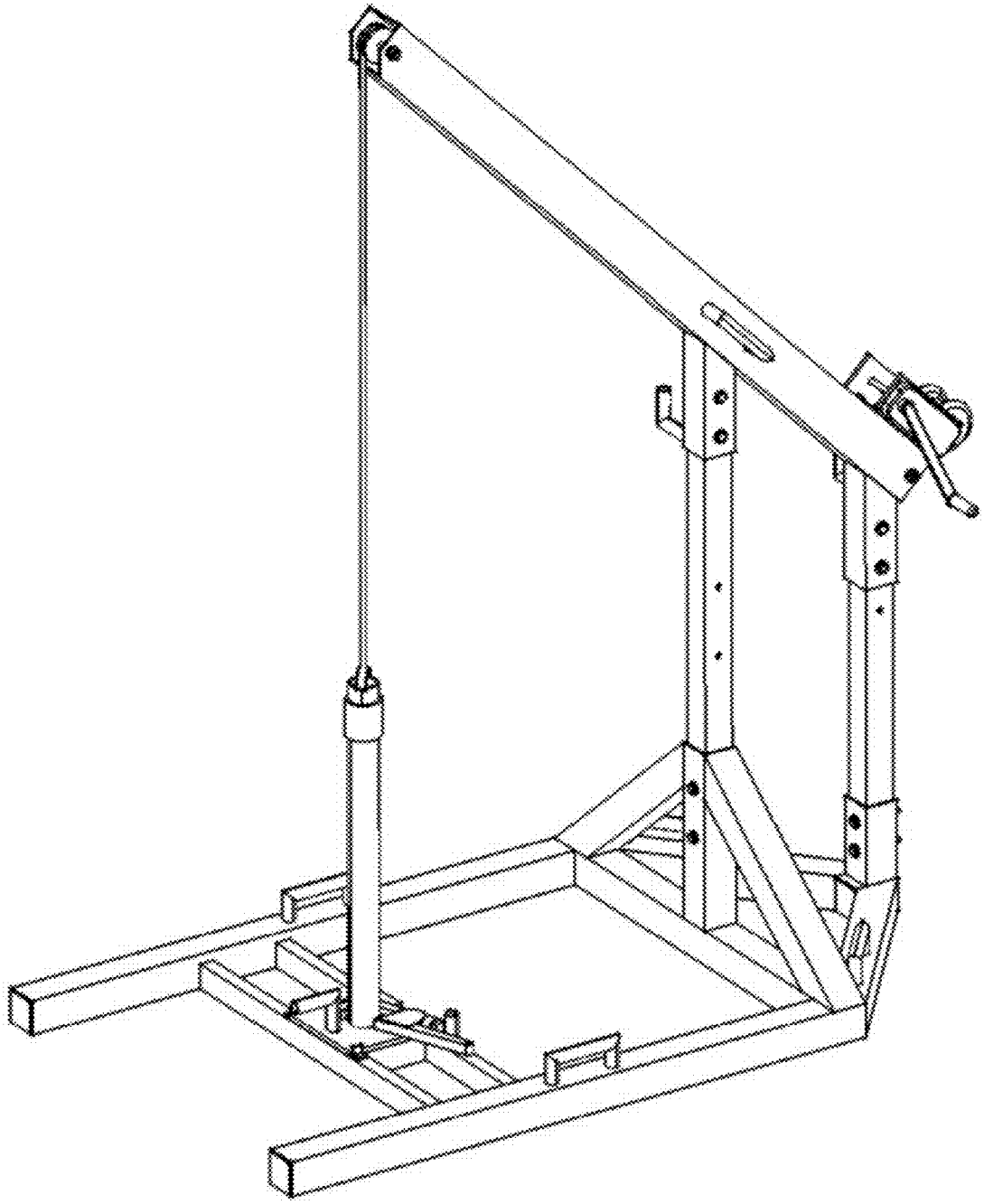
Figure 40:
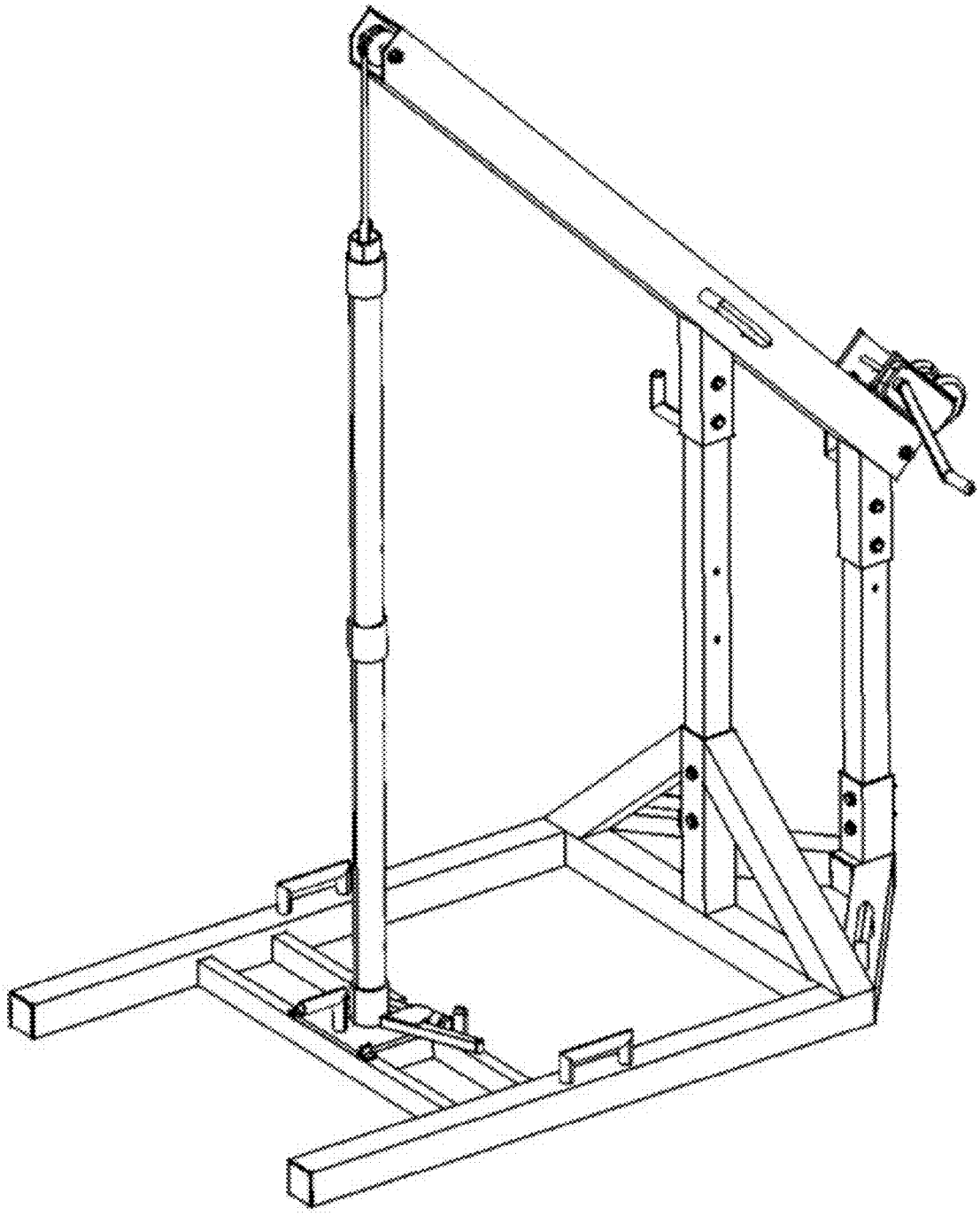
Figure 41:
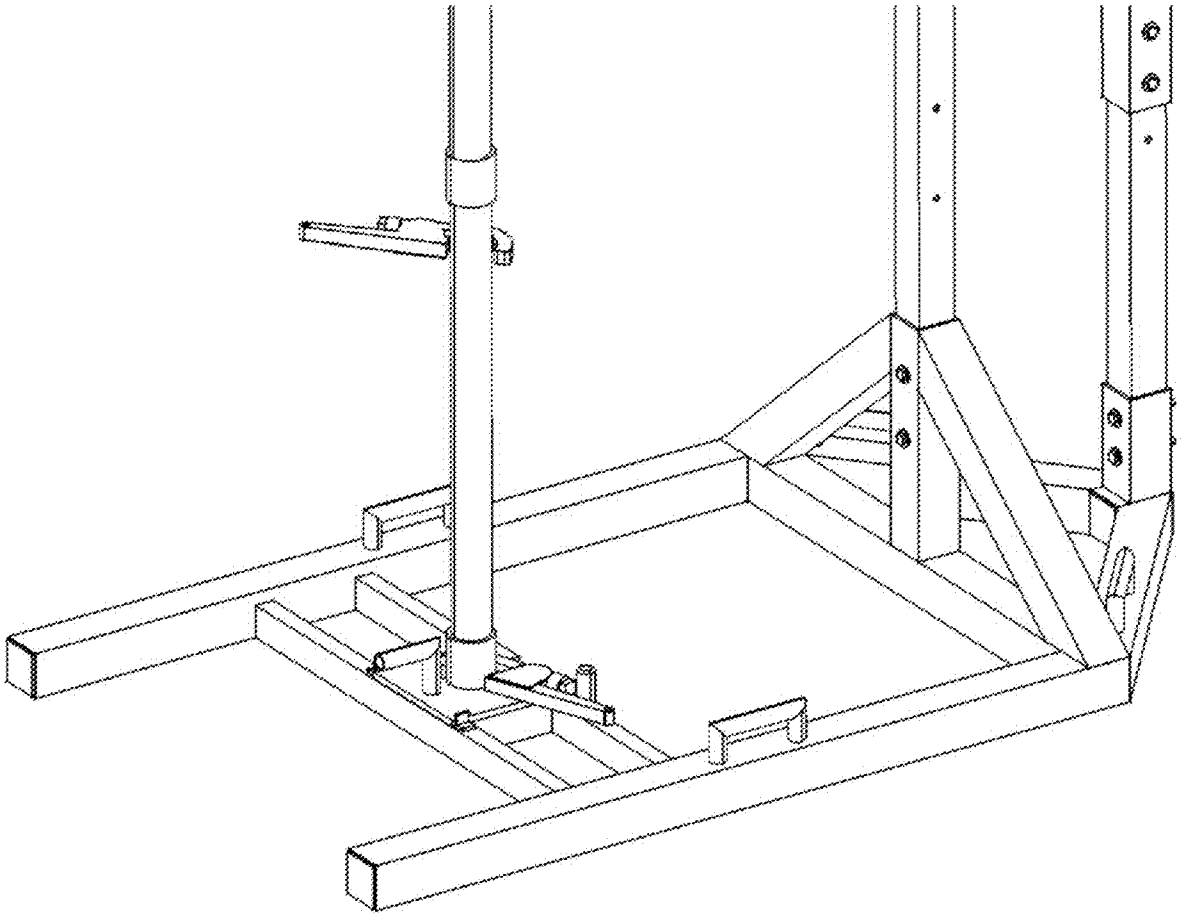
Figure 42:
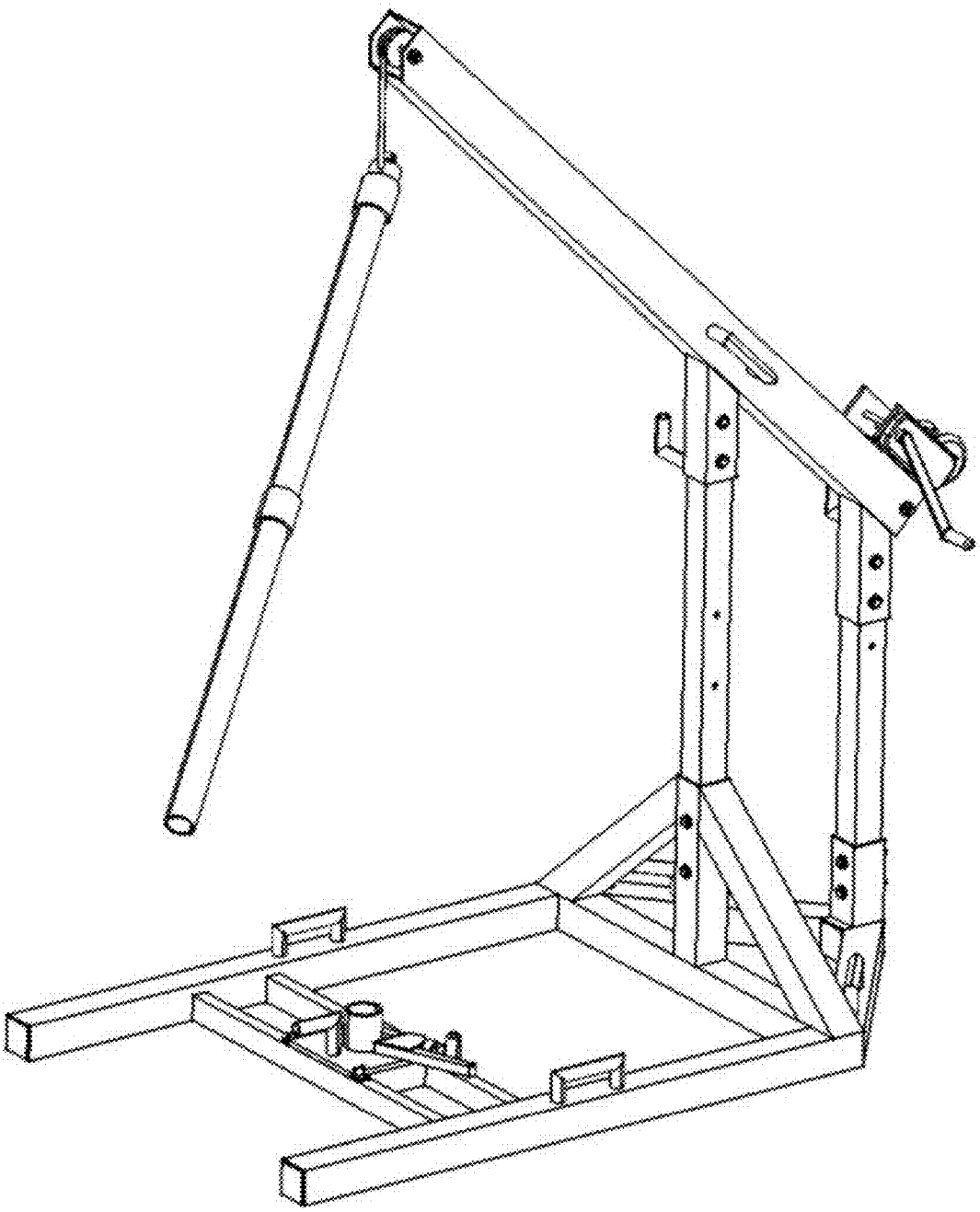

A hook 114 is then threaded into the remaining top coupler 80 by hand, securing the pipe string with the pipe wrench 82, as shown in FIG. 38. The winch rope is attached to the hook 114, and the winch 44 is used to raise the pipe string, sliding through the slip plate 38 for safety, as shown in FIG. 39. Throughout the process, care should be taken to ensure that the slip plate 38 remains in place as much as possible to prevent loss of the pipe string down the borehole, and two slip plates 38 may optionally be used to ensure that one slip plate 38 always secures the pipe string. Once two pipe segments have been raised up as shown in FIG. 40, the slip plate 38 is repositioned to secure the lowermost visible coupler. Two pipe wrenches 82 are then used as shown in FIG. 41 to untighten the two pipe segments from the lower coupler 80. The two pipe segments are then removed as shown in FIG. 42, and the process repeats from FIG. 38 until the entire pipe string has been removed.

Once the entire pipe string has been removed, the slurry is removed from around the borehole, such as by using a bailer or other method, and a plastic or metal casing is inserted the length of the borehole. Gravel is then packed around the outside of the casing, and the pump and connecting pipe is lowered to the bottom of the hole. The Bentonite slurry used to drill the hole is flushed out, and the ground surface around the casing is sealed with cement or with another method. Then a water wheel or pump is installed at ground level to draw up the water.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A borehole drill comprising:

a rotatable wheel having a substantially-vertical axis of rotation, the rotatable wheel being supported above an underlying surface at a supported height sufficient to permit a section of drill pipe to be inserted vertically between the underlying surface and the wheel, the rotatable wheel comprising:

a central aperture having a shape that facilitates transfer of torque from the wheel to an elongate object having a cross-sectional shape similar to but slightly smaller than the shape of the central aperture when the elongate object is inserted into the central aperture;

a hub; and spokes extending from the hub;

a supporting structure configured to support the wheel at the supported height and further configured to selectively support the elongate object passing through the central aperture of the wheel without the supporting structure obstructing an area immediately below the central aperture of the wheel between the wheel and the underlying surface, the supporting structure comprising:

a base configured to rest on the underlying surface;

a substantially vertical support secured to the base; and a cantilevered beam secured to the substantially vertical support and having a distal end terminating above the central aperture; and the elongate object having the cross-sectional shape along a majority of its major axis that is similar to but slightly smaller than the shape of the central aperture, the elongate object comprising:

a first end configured to be attached to a pipe string below the wheel; and a second end configured to be attached to a support from which to suspend and support the elongate object and any pipe string attached to the first end of the elongate object.

2. A borehole drill as recited in claim 1, wherein the elongate object is a Kelly bar.

3. A borehole drill as recited in claim 1, wherein the elongate object has a square cross section and the central aperture is square shaped.

4. A borehole drill as recited in claim 1, wherein the rotatable wheel comprises a handle to permit the rotatable wheel to be grasped and rotated by a human operator.

5. A borehole drill as recited in claim 1, wherein the drill comprises a winch that is configured to be functionally attached to the elongate object and to suspend and support the elongate object with a portion of the elongate object within the central aperture.

6. A borehole drill as recited in claim 1, wherein the supported height is between approximately three and one-half feet and approximately four and one-half feet above the underlying surface.

7. A borehole drill as recited in claim 1, wherein the rotatable wheel is not operatively connected to any machine that could provide a rotational force to the wheel.

8. A borehole drill as recited in claim 1, further comprising a winch with a wire rope configured to extend through the cantilevered beam, the wire rope further configured to attach to the second end of the elongate object.

9. A borehole drill as recited in claim 1, further comprising a wheel support configured to support the wheel and secured to the supporting structure.

10. A borehole drill comprising:

a rotatable wheel having a substantially-vertical axis of rotation, the rotatable wheel being supported above an underlying surface at a supported height sufficient to permit a section of drill pipe to be inserted vertically between the underlying surface and the wheel, the rotatable wheel comprising a hub having a square central aperture and a plurality of spokes extending horizontally from the hub;

wherein each of the spokes as a vertically-disposed rod near an outward end of the spoke, the vertically-disposed rod serving as a handle to provide a location for a human to grip;

a supporting structure configured to support the wheel at the supported height and further configured to selectively support a Kelly bar passing through the central aperture of the wheel without the supporting structure obstructing an area immediately below the central aperture of the wheel between the wheel and the underlying surface; and a Kelly bar comprising:

a first end configured to be attached to a pipe string below the wheel; and a second end configured to be attached to a support from which to suspend and support the Kelly bar and any pipe string attached to the first end of the Kelly bar.

11. The borehole drill as recited in claim 10, wherein the spokes are removable.

12. The borehole drill as recited in claim 10, further comprising a wheel support and bearing supporting the wheel at the supported height while providing access to a space under the wheel from three orthogonal directions.

13. The borehole drill as recited in claim 10, wherein each of the plurality of spokes has a proximal end and a distal end, and wherein the proximal end is attached to the hub, and wherein the handle is attached at or near the distal end of at least one of the spokes.

14. A borehole drill configured to be human powered, the borehole drill comprising:

a rotatable wheel having a substantially-vertical axis of rotation, the rotatable wheel being supported above an underlying surface at a supported height sufficient to permit a section of drill pipe to be inserted vertically between the underlying surface and the wheel, the rotatable wheel comprising:

a hub having a central aperture having a shape that facilitates transfer of torque from the wheel to an elongate object having a cross-sectional shape similar to but slightly smaller than the shape of the central aperture when the elongate object is inserted into the central aperture; and a plurality of spokes attached to and extending substantially horizontally from the hub, each of the plurality of spokes having a proximal end and a distal end, the proximal end being attached to the hub, and a handle being attached at or near the distal end of at least one of the spokes;

a supporting structure configured to support the wheel at the supported height and further configured to selectively support the elongate object passing through the central aperture of the wheel without the supporting structure obstructing an area immediately below the central aperture of the wheel between the wheel and the underlying surface; and the elongate object having a cross-sectional shape along a majority of its major axis that is similar to but slightly smaller than the shape of the central aperture, the elongate object comprising:

a first end configured to be attached to a pipe string below the wheel; and a second end configured to be attached to a support from which to suspend and support the elongate object and any pipe string attached to the first end of the elongate object.

15. The borehole drill as recited in claim 14, wherein a handle is attached at or near the distal end of each of the spokes.

16. The borehole drill as recited in claim 14, further comprising a thrust bearing supporting the rotatable wheel on the supporting structure.

17. The borehole drill as recited in claim 14, wherein the supporting structure comprises a wheel support adapted to support the rotatable wheel while allowing unimpeded access to drill pipe beneath the rotatable wheel from at least three orthogonal directions, the wheel support comprising:

a platform adapted to support a bearing to support and provide substantially horizontal rotation of the rotatable wheel; and a supporting frame extending horizontally in a single direction from the platform, the supporting frame adapted to be secured to one or more vertical beams of the supporting structure.

* * * * *